US007887930B2

(12) United States Patent
Bishop et al.

(10) Patent No.: US 7,887,930 B2
(45) Date of Patent: Feb. 15, 2011

(54) CRYSTALLINE CHROMIUM DEPOSIT

(75) Inventors: Craig V. Bishop, Fort Mill, SC (US); Agnes Rousseau, Rock Hill, SC (US); Zoltan Mathe, Easton, CT (US)

(73) Assignee: Atotech Deutschland GmbH, Berlin (DE)

( * ) Notice: Subject to any disclaimer, the term of this patent is extended or adjusted under 35 U.S.C. 154(b) by 975 days.

(21) Appl. No.: 11/692,523

(22) Filed: Mar. 28, 2007

(65) Prior Publication Data

US 2007/0227895 A1 Oct. 4, 2007

Related U.S. Application Data

(60) Provisional application No. 60/788,387, filed on Mar. 31, 2006.

(51) Int. Cl.
*B32B 15/01* (2006.01)
*C25D 3/06* (2006.01)

(52) U.S. Cl. ..... 428/666; 428/935; 205/243

(58) Field of Classification Search ..... None
See application file for complete search history.

(56) References Cited

U.S. PATENT DOCUMENTS

| | | | | |
|---|---|---|---|---|
| 900,597 | A | 10/1908 | Salzer | |
| 1,496,845 | A | 6/1924 | Grube | |
| 2,470,378 | A | 5/1949 | Skala | |
| 2,927,066 | A | 3/1960 | Schaer | 204/43 |
| 2,962,428 | A | 11/1960 | Passal | 204/51 |
| 3,649,479 | A | 3/1972 | Icxi | 204/51 |
| 3,788,957 | A | 1/1974 | Christie | 204/51 |
| 3,833,485 | A | 9/1974 | Crowther et al. | 204/43 |
| 3,954,574 | A | 5/1976 | Gyllenspetz et al. | 204/43 |
| 4,038,160 | A | 7/1977 | Crowther et al. | 204/51 |
| 4,054,494 | A | 10/1977 | Gyllenspetz et al. | 204/43 |
| 4,062,740 | A | 12/1977 | Bauer et al. | 204/51 |
| 4,093,521 | A | 6/1978 | Renton et al. | 204/43 |
| 4,142,948 | A | 3/1979 | Tajima et al. | 204/51 |
| 4,157,945 | A | 6/1979 | Ward et al. | |
| 4,161,432 | A | 7/1979 | Barclay et al. | 204/51 |
| 4,167,460 | A | 9/1979 | Tomaszewski | 204/51 |
| 4,180,639 | A | 12/1979 | Caporiccio et al. | 526/243 |
| 4,293,620 | A | 10/1981 | Vigar | 428/667 |
| RE31,508 | E | 1/1984 | Barclay et al. | 204/43 |
| 4,432,843 | A | 2/1984 | Tremmel | |
| 4,448,648 | A | 5/1984 | Barclay et al. | 204/51 |
| 4,448,649 | A | 5/1984 | Barclay et al. | 204/51 |
| 4,450,052 | A | 5/1984 | McMullen et al. | 204/51 |
| 4,461,680 | A | 7/1984 | Lashmore | 204/41 |
| 4,472,250 | A | 9/1984 | Barclay et al. | 204/51 |
| 4,473,448 | A | 9/1984 | Deeman | |
| 4,477,318 | A | 10/1984 | Tomaszewski | 204/51 |
| 4,502,927 | A | 3/1985 | Barclay et al. | |
| 4,507,178 | A | 3/1985 | Barclay | 204/29 |
| 4,543,167 | A | 9/1985 | Seyb, Jr. et al. | 204/51 |
| 4,610,763 | A | 9/1986 | Law | 204/35.1 |
| 4,612,091 | A | 9/1986 | Benaben et al. | 204/51 |
| 4,673,471 | A | 6/1987 | Kagechika et al. | 204/44.5 |
| 4,690,735 | A | 9/1987 | Laitinen et al. | 204/37.1 |
| 4,804,446 | A | 2/1989 | Lashmore et al. | 204/51 |
| 4,877,494 | A | 10/1989 | Kanamaru et al. | 204/28 |
| 4,897,317 | A | 1/1990 | Kanamaru et al. | 428/629 |
| 5,196,109 | A | 3/1993 | Scott | 205/289 |
| 5,269,905 | A | 12/1993 | Reynolds | 205/101 |
| 5,273,643 | A | 12/1993 | Hasegawa et al. | 205/155 |
| 5,294,326 | A | 3/1994 | Shahin | 205/287 |
| 5,338,433 | A | 8/1994 | Maybee et al. | 205/178 |
| 5,352,266 | A | 10/1994 | Erb et al. | |
| 5,415,763 | A | 5/1995 | Johnson et al. | 205/287 |
| 5,433,797 | A | 7/1995 | Erb et al. | |
| 5,578,167 | A | 11/1996 | Sooriakumar et al. | 156/654.1 |
| RE35,730 | E | 2/1998 | Reynolds | 205/101 |
| 5,770,090 | A | 6/1998 | Lewis, III | 210/662 |
| 5,868,917 | A | 2/1999 | Benaben | 205/109 |
| 6,329,071 | B1 | 12/2001 | Kobayashi et al. | |
| 6,719,852 | B2 | 4/2004 | Oshima et al. | |
| 6,736,954 | B2 | 5/2004 | Cobley et al. | 205/238 |

(Continued)

FOREIGN PATENT DOCUMENTS

| | | |
|---|---|---|
| GB | 1098066 | 1/1968 |

(Continued)

OTHER PUBLICATIONS

English translation of JP 03-255270 A, Translated by FLS Inc., Sep. 2010.*

(Continued)

*Primary Examiner*—Jennifer C McNeil
*Assistant Examiner*—Adam C Krupicka
(74) *Attorney, Agent, or Firm*—Renner, Otto, Boisselle & Sklar, LLP

(57) ABSTRACT

A crystalline chromium deposit having a lattice parameter of 2.8895+/−0.0025 Å, and an article including the crystalline chromium deposit. An article including a crystalline chromium deposit, wherein the crystalline chromium deposit has a {111} preferred orientation. A process for electrodepositing a crystalline chromium deposit on a substrate, including providing an electroplating bath comprising trivalent chromium and a source of divalent sulfur, and substantially free of hexavalent chromium; immersing a substrate in the electroplating bath; and applying an electrical current to deposit a crystalline chromium deposit on the substrate, wherein the chromium deposit is crystalline as deposited.

19 Claims, 9 Drawing Sheets

U.S. PATENT DOCUMENTS

| | | | | |
|---|---|---|---|---|
| 6,773,573 | B2 | 8/2004 | Gabe et al. | 205/296 |
| 6,858,098 | B2 | 2/2005 | Oshima et al. | |
| 2001/0054557 | A1 | 12/2001 | Taylor et al. | 205/103 |
| 2003/0070934 | A1 | 4/2003 | Cobley et al. | 205/263 |
| 2004/0074778 | A1 | 4/2004 | Cobley et al. | 205/261 |
| 2004/0206631 | A1 | 10/2004 | Cobley et al. | 205/291 |
| 2005/0284769 | A1 | 12/2005 | Edigaryan | 205/287 |
| 2008/0166531 | A1 | 7/2008 | Schuh et al. | |
| 2008/0169199 | A1 | 7/2008 | Huang et al. | |
| 2009/0114544 | A1 | 5/2009 | Rousseau et al. | |

FOREIGN PATENT DOCUMENTS

| | | |
|---|---|---|
| GB | 2124656 | 2/1984 |
| GB | 2141138 | 12/1984 |
| GB | 2171114 | 8/1986 |
| JP | 03255270 A * | 11/1991 |
| WO | 8203095 | 9/1982 |

OTHER PUBLICATIONS

International Search Report and Written Opinion, Application No. PCT/US2007/065345, mailed Aug. 23, 2007.

Sakamoto; "On the crystal structures and electrolytic conditions of chromium electrodeposits"; Journal of the Japan Institute of Metals; vol. 36, No. 5, May 1972, pp. 450-457.

Translation of Sakamoto; "On the crystal structures and electrolytic conditions of chromium electrodeposits"; Journal of the Japan Institute of Metals; vol. 36, No. 5, May 1972, pp. 450-457.

Sillers Jr.; "Note on the crystal structure of electrodeposited chromium"; Transactions of the American Electrochemical Society; vol. 52, 1927, pp. 301-308.

Gelchinski et al.; "Pulse Plating of Chromium-cobalt Alloys Containing a Phase with the A-15 Structure"; Journal of the Electrochemical Society, vol. 129, No. 11, Nov. 1982, pp. 2433-2438.

Cleghorn et al.; "Structure of electrodeposited chromium"; Electrochimica Acts, Elsevier Science Publishers, vol. 13, No. 3, Mar. 1968, pp. 331-334.

Pangarov et al.; "Preferred orientation of electrodeposited iron crystallites"; Electrochimica ACTA, vol. 11, 1966, pp. 1719-1731.

Song et al.; "Pulse Plating of Hard Chromium from a Trivalent Chromium Bath"; *Plating and Surface Finishing*; vol. 87, No. 9, pp. 80-87 (2000).

Kawamura et al.; "Hard Chromium plating system using trivalent chromium Bath Containing Ammonium Chloride and Glycine"; Masushi Institute of Technology; PowerPoint presented at ECOCHROM, Jan. 24-26, 2006, San Diego; 35 pages.

Test of 100 liter Hoshino bath in Koka Chrom. Co. Ltd.; PowerPoint presented at ECOCHROM, Jan. 24-26, 2006, San Diego; 16 pages.

ECOCHROM; A Growth-IMS project; Hard Chrome Alternatives Team; PowerPoint presented at ECOCHROM, Jan. 24-26, 2006, San Diego; 16 pages.

ECOCHROM; A Growth-IMS project; Eco-efficient hard chrome chromium process; PowerPoint presented at ECOCHROM, Jan. 24-26, 2006, San Diego; 28 pages.

ECOCHROM: Results Jan. 25, 2006; Ecole Nationale Superieure des Mines; PowerPoint presented at ECOCHROM, Jan. 24-26, 2006, San Diego; 41 pages.

McDougall et al.; Chromium electrodeposition using a chromium(III) glycine complex; *Journal of Applied Electrochemistry* 28 (1998) 929-934.

Nakade et al.; Electrodeposition of Cr-P-C Alloy Film from Trivalent Chromium Bath; Technology Research Inst. of Osaka Pref.; Vo. 49, No. 9, 1998.

Watson; "The Development of Trivalent Chromium Plating"; Presented at a conference in England, Apr. 1992.

Zhenmi et al.; "Behaviours of Trichrome Electroplating in Cathode Polarization"; Harbin Institute of Technology. Date Unknown.

Hoare; "On the Role of Additives in a Trivalent chromium Plating Bath"; General Motors Research Laboratories; 1985.

Szynkarczuk et al.; "Electrodeposition of chromium from Cr(III) electrolytes in the presence of formic acid"; Institute of Inorganic Technology and Mineral Fertilizers; pp. 933-936; 1989.

Snyder; "The Decorative Colors of Trivalent Chromium Deposits"; AESF SUR/FIN® 2002 Proceedings.

Kudryavtsev et al.; "Thick Chromium Electroplating from Cr (III) Bath"; Mendeleyev University of Chemical Technology.

Cherrat et al.; "Fundamental Study of Electrodeposition of Chromium in Fused Salts by Pulse Techniques"; *Material Science Forum*; vol. 73-75 (1991); pp. 349-356.

Tomashova et al.; "Mechanism of the Electrodeposition of chromium from Trivalent Compounds"; Translated from *Zashchita Metallov*, vol. 4, No. 4, pp. 403-408, Jul.-Aug. 1968.

El-Sharif et al.; "Environmentally Acceptable Process for Electrodeposition of Hard Chromium From Chromium (III) Electrolyte"; *Trans IMF*; 1995, 73(1), 19-25.

Sweynert et al.; "Alternative Anode Reactions for Electrodeposition of Chromium From Cr (III) Baths"; *Dechema-Monographien*; vol. 125, pp. 453-458; (Date uncertain but 1995 or before).

Howarth et al.; "The electrodeposition of chromium from chromium (III) solutions—a study using microelectrodes"; *Journal of Applied Electrochemistry* 18 (1988) 644-652.

Barclay et al.; "A New Trivalent Chromium Electroplating Solution"; Proceedings of INTERFINISH 80; 1980; pp. 79-83.

Hoare; "On the Role of Additives in a Trivalent Chromium Plating Bath"; General Motors Research Laboratories; for Presentation at the American Electroplaters' Society, 1985.

Vinokurov et al.; "Certain Laws of the Electrodeposition of a Chromium-Phosphorus Alloy"; Translated from Zashchita Metallov, vol. 27, No. 3, pp. 448-452, May-Jun. 1991.

Tu et al.; "Pulse Plating with a Trivalent Chromium Plating Bath"; *Plating and Surface Finishing*; Oct. 1990.

Hsieh et al.; "The Electron Spectroscopy of Chromium Deposits from Trivalent and Hexavalent Chromium Baths"; *Metal Finishing*; Mar. 1991.

Watson et al.; "The role of chromium II catalysed olation reactions in the sustained deposition of chromium and its alloys from environmentally acceptable chromium III electrolytes"; Paper presented at 1990 IMF Annual Meeting.

Danilov et al.; "Influence of Electrolyte Composition on Cr(III) Oxidation at Manganese Dioxide Anodes"; Translated from *Elektrokhimiya*; vol. 26, No. 9, pp. 1185-1187, Sep. 1990.

Hwang; "Trivalent Chromium Electroplating for Baths Containing Hypophosphite Ions"; *Plating and Surface Finishing*; May 1991.

Newby; "What Seems to be Holding Back Functional Trivalent Chromium Plating"; Paper presented at IVth International Chromium Colloquium; May 2004.

Willis; "Structure of chromium deposits from plating solutions containing trivalent and hexavalent chromium"; *Materials Science and Technology*; vol. 2, Jun. 1986.

Hong et al.; "Hard Chromium Plating From Trivalent Chromium Solution"; *Plating and Surface Finishing*; Mar. 2001.

Suvegh; "Application of positron lifetime spectroscopy to the study of electrodeposited chromium layers"; *Journal of Electroanalytical Chemistry* 455 (1998) 69-73.

Lee et al.; "Grain Orientations in Electrolytic High Contraction and Low Contraction Chromium Deposition"; JCPDS—International Centre for Diffraction Data, 1999, pp. 707-717.

Edigaryan et al.; "Electroplating from Concentrated Cr(III) Sulfate Solutions and the Properties of Chromium Deposits"; *Protection of Metals*; vol. 34, No. 2, 1998, pp. 95-100.

Edigaryan et al.; "Effect of Fluoride Ions on Chromium Deposition from Sulfuric Acid Solutions of Cr(III)"; *Protection of Metals*; vol. 35, No. 1, 1999, pp. 1-3.

Edigaryan et al.; "Chromium Deposition from Diluted Sulfate Solutions"; *Protection of Metals*; vol. 32, No. 5, 1996, pp. 461-464.

Edigaryan et al.; "Anodic Processes in Chromium Electrodeposition from Cr(III) Sulfate Solution"; *Protection of Metals*; vol. 34, No. 6, 1998, pp. 545-548.

Danilov et al. "Anodic Processes in a Sulfate Electrolyte on the Basis of Trivalent Chromium Salts"; translated from Elektrokhimiya, vol. 23, No. 7, pp. 988-991, Jul. 1987.

Shichi Ishida et al.; "Effects of Adding an Aluminum Salt to a Trivalent Chromium Plating Bath"; *Journal of the Hard Chrome Platers Association of Japan*; vol. 17, No. 2, Oct. 31, 2002, and English language translation attached.

Polukarov et al.; "Chrome Plating from Sulfate-Oxalate Cr(III) Baths. Structure, Composition, and Corrosion Behavior"; *Protection of Metals*, Vo. 37, No. 5, 2001, pp. 447-451.

Baral et al.; "Modeling, Optimization, and Comparative Analysis of Trivalent Chromium Electrodeposition from Aqueous Glycine and Formic Acid Baths"; *Journal of the Electrochemical Society*; 152 (7) C504-0512 (2005).

International Search Report and Written Opinion, Application No. PCT/US2008/078561, mailed Oct. 2, 2008.

E.N. Lubnin; X-ray Photoelectron Spectroscopy of Chromium Layers Electroplated from Oxalate-Sulfate Solutions, Protection of Metals, vol. 36, No. 4, 2000, pp. 301-305.

Huang et al.; "Characterization of Cr-Ni multilayers electroplated from a chromium(III)-nickel(II) bath using pulse current"; Scripta Materialia 57 (2007), pp. 61-64.

* cited by examiner

CRYSTALLINE CHROMIUM DEPOSIT

CROSS REFERENCE TO RELATED APPLICATION

The present application is related to and claims benefit under 35 U.S.C. §119 to U.S. Provisional Application No. 60/788,387, filed 31 Mar. 2006, the entirety of which is hereby incorporated herein by reference.

TECHNICAL FIELD

The present invention relates generally to electrodeposited crystalline chromium deposited from trivalent chromium baths, methods for electrodepositing such chromium deposits and articles having such chromium deposits applied thereto.

BACKGROUND

Chromium electroplating began in the early twentieth or late $19^{th}$ century and provides a superior functional surface coating with respect to both wear and corrosion resistance. However, in the past, this superior coating, as a functional coating (as opposed to a decorative coating), has only been obtained from hexavalent chromium electroplating baths. Chromium electrodeposited from hexavalent chromium baths is deposited in a crystalline form, which is highly desirable. Amorphous forms of chromium plate are not useful. The chemistry that is used in present technology is based on hexavalent chromium ions, which are considered carcinogenic and toxic. Hexavalent chromium plating operations are subject to strict and severe environmental limitations. While industry has developed many methods of working with hexavalent chromium to reduce the hazards, both industry and academia have for many years searched for a suitable alternative.

Given the importance and superiority of chromium plating, the most obvious alternative source of chromium for chromium plating is trivalent chromium. Trivalent chromium salts are much less hazardous to health and the environment than hexavalent chromium compounds. Many different trivalent chromium electrodeposition baths have been tried and tested over the years. However, none of such trivalent chromium baths have succeeded in producing a reliably consistent chromium deposit that is comparable to that obtained from hexavalent chromium electrodeposition processes.

Hexavalent chromium is very toxic and is subject to regulatory controls that trivalent chromium is not. The most recent OSHA rule for hexavalent chromium exposure was published in 29 CFR Parts 1910, 1915, et al., *Occupational Exposure to Hexavalent Chromium; Final Rule*. In this Rule, substitution is described as an "ideal (engineering) control measure" and "replacement of a toxic materials with a less hazardous alternative should always be considered" (*Federal Register/Vol.* 71, *No.* 39/*Tuesday, Feb.* 28, 2006/*Rules and Regulations* pp. 10345). Thus, there are strong government-based mandates to replace hexavalent chromium with another form of chromium. However, until the present invention, no process has been successful in electrodepositing a reliably consistent crystalline chromium deposit from a trivalent or other non-hexavalent chromium electroplating bath.

In general, in the prior art, all of the trivalent chromium electrodeposition processes form an amorphous chromium deposit. While it is possible to anneal the amorphous chromium deposit at about 350 to 370° C., and create thereby a crystalline chromium deposit, the annealing results in the formation of macrocracks, which are undesirable, rendering the chromium deposit essentially useless. Macrocracks are defined as cracks that extend through the entire thickness of the chromium layer, down to the substrate. Since the macrocracks reach the substrate, thus giving ambient materials access to the substrate, the chromium deposit cannot provide its function of corrosion resistance. The macrocracks are believed to arise from the process of crystallization, since the desired body-centered cubic crystalline form has a smaller volume than does the as-deposited amorphous chromium deposit and the resulting stress causes the chromium deposit to crack, forming the macrocracks. By contrast, crystalline chromium deposits from hexavalent electrodeposition processes generally include microcracks that are smaller and extend only a fraction of the distance from the surface of the deposit towards the substrate, and do not extend through the entire thickness of the chromium deposit. There are some instances in which a crack-free chromium deposit from a hexavalent chromium electrolyte can be obtained. The frequency of microcracks in chromium from hexavalent chromium electrolytes, where present, is on the order of 40 or more cracks per centimeter, while the number of macrocracks in amorphous deposits from trivalent chromium electrolytes annealed to form crystalline chromium, where present, is about an order of magnitude less. Even with the much lower frequency, the macrocracks render the trivalent chromium derived crystalline deposit unacceptable for functional use. Functional chromium deposits need to provide both wear resistance and corrosion resistance, and the presence of macrocracks renders the article subject to corrosion, and thus such chromium deposits are unacceptable.

Trivalent chromium electrodeposition processes can successfully deposit a decorative chromium deposit. However, decorative chromium is not functional chromium, and is not capable of providing the benefits of functional chromium.

While it would appear to be a simple matter to apply and adapt the decorative chromium deposit to functional chromium deposits, this has not occurred. Rather, for years the goal has continued to elude the many efforts directed at solving this problem and reaching the goal of a trivalent chromium electrodeposition process that can form a crystalline chromium deposit.

Another reason for seeking a trivalent chromium electrodeposition process is that trivalent chromium based processes theoretically require about half as much electrical energy as a hexavalent process. Using Faraday's law, and assuming the density of chromium to be 7.14 g/cm$^3$ the plating rate of a 25% cathodic efficiency process with 50 A/dm$^2$ applied current density is 56.6 microns per dm$^2$ per hour for a hexavalent chromium plating process. With similar cathodic efficiencies and current density a deposit of chromium from the trivalent state would have twice the thickness in the same time period.

For all these reasons, a long-felt need remains for a functional crystalline-as-deposited chromium deposit, an electrodeposition bath and process capable of forming such a chromium deposit and articles made with such a chromium deposit, in which the chromium deposit is free of macrocracks and is capable of providing functional wear and corrosion resistance characteristics comparable to the functional hard chromium deposit obtained from a hexavalent chromium electrodeposition process. The urgent need for a bath and process capable of providing a crystalline functional chromium deposit from a bath substantially free of hexavalent chromium heretofore has not been satisfied.

SUMMARY

The present invention provides a chromium deposit which is crystalline when deposited, and which is deposited from a trivalent chromium solution.

The present invention, although possibly useful for formation of decorative chromium deposits, is primarily directed to functional chromium deposits, and in particular for functional crystalline chromium deposits which heretofore have only been available through hexavalent chromium electrodeposition processes.

The present invention provides a solution to the problem of providing a crystalline functional chromium deposit from a trivalent chromium bath substantially free of hexavalent chromium, but which nevertheless is capable of providing a product with functional characteristics substantially equivalent to those obtained from hexavalent chromium electrodeposits. The invention provides a solution to the problem of replacing hexavalent chromium plating baths.

Figure 1:
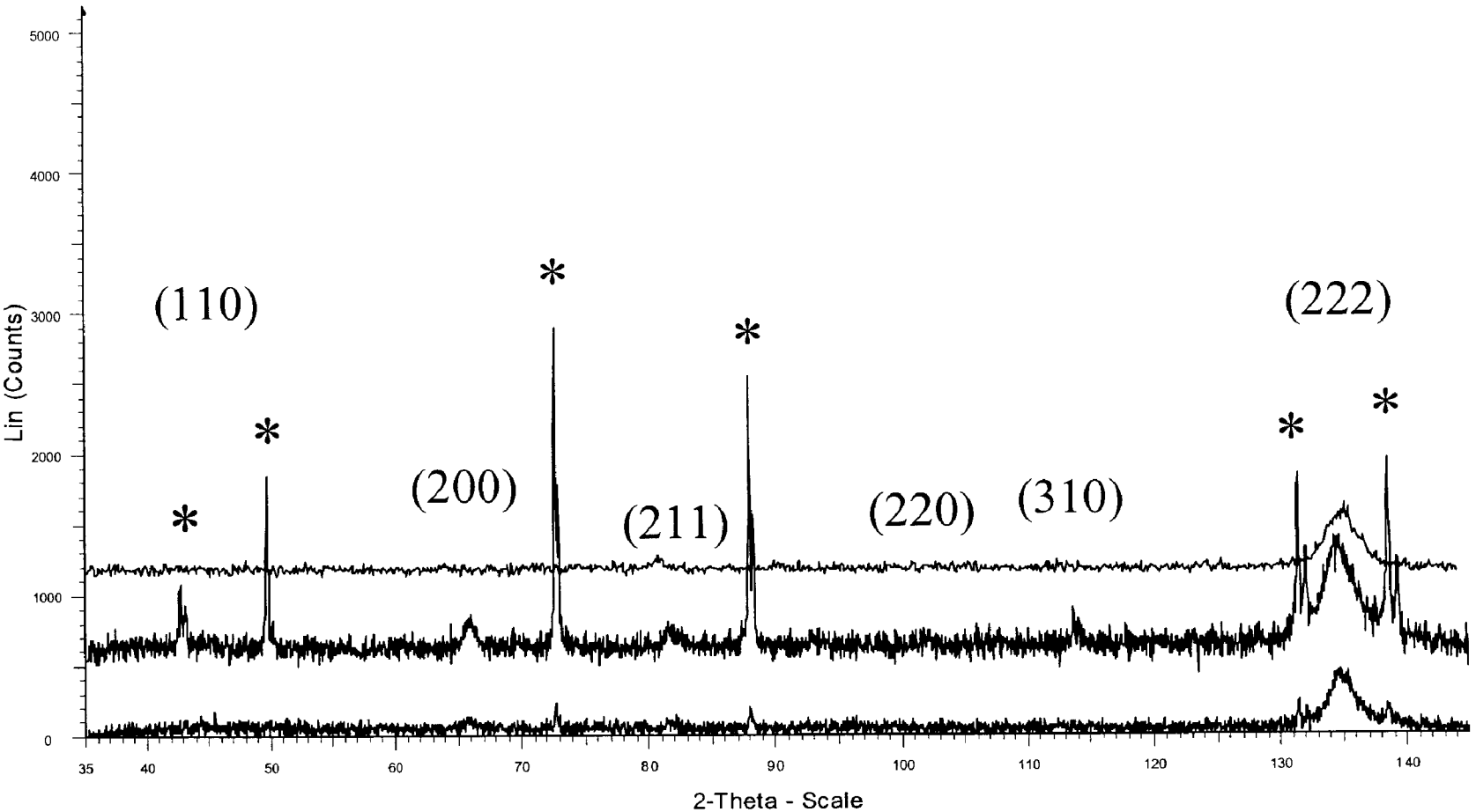
FIG. 1 includes three X-ray diffraction patterns (Cu k alpha) of crystalline chromium deposited in accordance with an embodiment of the present invention and with hexavalent chromium of the prior art.

It should be appreciated that the process steps and structures described below do not form a complete process flow for manufacturing parts containing the functional crystalline chromium deposit of the present invention. The present invention can be practiced in conjunction with fabrication techniques currently used in the art, and only so much of the commonly practiced process steps are included as are necessary for an understanding of the present invention.

DETAILED DESCRIPTION

As used herein, a decorative chromium deposit is a chromium deposit with a thickness less than one micron, and often less than 0.8 micron, typically applied over an electrodeposited nickel or nickel alloy coating, or over a series of copper and nickel or nickel alloy coatings whose combined thicknesses are in excess of three microns.

As used herein, a functional chromium deposit is a chromium deposit applied to (often directly to) a substrate such as strip steel ECCS (Electrolytically Chromium Coated Steel) where the chromium thickness is generally greater than 0.8 or 1 micron, and is used for industrial, not decorative, applications. Functional chromium deposits are generally applied directly to a substrate. Industrial coatings take advantage of the special properties of chromium, including its hardness, its resistance to heat, wear, corrosion and erosion, and its low coefficient of friction. Even though it has nothing to do with performance, many users want the functional chromium deposits to be decorative in appearance. The thickness of the functional chromium deposit may range from the above-noted 0.8 or 1 micron to 3 microns or much more. In some cases, the functional chromium deposit is applied over a 'strike plate' such as nickel or iron plating on the substrate or a 'duplex' system in which the nickel, iron or alloy coating has a thickness greater than three microns and the chromium thickness generally is in excess of three microns. Functional chromium plating and deposits are often referred to as "hard" chromium plating and deposits.

Decorative chromium plating baths are concerned with thin chromium deposits over a wide plating range so that articles of irregular shape are completely covered. Functional chromium plating, on the other hand, is designed for thicker deposits on regularly shaped articles, where plating at a higher current efficiency and at higher current densities is important. Previous chromium plating processes employing trivalent chromium ion have generally been suitable for forming only "decorative" finishes. The present invention provides "hard" or functional chromium deposits, but is not so limited, and can be used for decorative chromium finishes. "Hard" or "functional" and "decorative" chromium deposits are known terms of art.

As used herein, when used with reference to, e.g., an electroplating bath or other composition, "substantially free of hexavalent chromium" means that the electroplating bath or other composition so described is free of any intentionally added hexavalent chromium. As will be understood, such a bath or other composition may contain trace amounts of hexavalent chromium present as an impurity in materials added to the bath or composition or as a by-product of electrolytic or chemical processes carried out with bath or composition.

As used herein, the term "preferred orientation" carries the meaning that would be understood by those of skill in the crystallographic arts. Thus, "preferred orientation" is a condition of polycrystalline aggregate in which the crystal orientations are not random, but rather exhibit a tendency for alignment with a specific direction in the bulk material. Thus, a preferred orientation may be, for example, {100}, {110}, {111} and integral multiples thereof, such as (222).

The present invention provides a reliably consistent body centered cubic (BCC) crystalline chromium deposit from a trivalent chromium bath, which bath is substantially free of hexavalent chromium, and in which the chromium deposit is crystalline as deposited, without requiring further treatment to crystallize the chromium deposit. Thus, the present invention provides a solution to the long-standing, previously unsolved problem of obtaining a reliably consistent crystalline chromium deposit from an electroplating bath and a process which are substantially free of hexavalent chromium.

In one embodiment, the crystalline chromium deposit of the present invention is substantially free of macrocracks, using standard test methods. That is, in this embodiment, under standard test methods, substantially no macrocracks are observed when samples of the chromium deposited are examined.

In one embodiment, the crystalline chromium deposit in accordance with the present invention has a cubic lattice parameter of 2.8895+/−0.0025 Angstroms (Å). It is noted that the term "lattice parameter" is also sometimes used as "lattice constant". For purposes of the present invention, these terms are considered synonymous. It is noted that for body centered cubic crystalline chromium, there is a single lattice parameter, since the unit cell is cubic. This lattice parameter is more properly referred to as a cubic lattice parameter, but herein is referred to simply as the "lattice parameter". In one embodiment, the crystalline chromium deposit in accordance with the present invention has a lattice parameter of 2.8895 Å+/−0.0020 Å. In another embodiment, the crystalline chromium deposit in accordance with the present invention has a lattice parameter of 2.8895 Å+/−0.0015 Å. In yet another embodiment, the crystalline chromium deposit in accordance with the present invention has a lattice parameter of 2.8895 Å+/−0.0010 Å. Some specific examples are provided herein of crystalline chromium deposits having lattice parameters within these ranges.

Pyrometallurgical, elemental crystalline chromium has a lattice parameter of 2.8839 Å.

Crystalline chromium electrodeposited from a hexavalent chromium bath has a lattice parameter ranging from about 2.8809 Å to about 2.8858 Å.

Annealed electrodeposited trivalent amorphous-as-deposited chromium has a lattice parameter ranging from about 2.8818 Å to about 2.8852 Å, but also has macrocracks.

Thus, the lattice parameter of the chromium deposit in accordance with the present invention is larger than the lattice parameter of other known forms of crystalline chromium. Although not to be bound by theory, it is considered that this difference may be due to the incorporation of heteroatoms, such as sulfur, nitrogen, carbon, oxygen and/or hydrogen in the crystal lattice of the crystalline chromium deposit obtained in accordance with the present invention.

In one embodiment, the crystalline chromium deposit in accordance with the invention has a {111} preferred orientation.

In one embodiment, the crystalline chromium deposit is substantially free of macrocracking. In one embodiment, the crystalline chromium deposit does not form macrocracks when heated to a temperature up to about 300° C. In one embodiment, the crystalline chromium deposit does not change its crystalline structure when heated to a temperature up to about 300° C.

In one embodiment, the crystalline chromium deposit further includes carbon, nitrogen and sulfur in the chromium deposit.

In one embodiment, the crystalline chromium deposit contains from about 1.0 wt. % to about 10 wt. % sulfur. In another embodiment, the chromium deposit contains from about 1.5 wt. % to about 6 wt. % sulfur. In another embodiment, the chromium deposit contains from about 1.7 wt. % to about 4 wt. % sulfur. The sulfur is in the deposit present as elemental sulfur and may be a part of crystal lattice, i.e., replacing and thus taking the position of a chromium atom in the crystal lattice or taking a place in the tetrahedral or octahedral hole positions and distorting the lattice. In one embodiment, the source of sulfur may be a divalent sulfur compound. More details on exemplary sulfur sources are provided below. In one embodiment, instead of or in addition to sulfur, the deposit contains selenium and/or tellurium.

It is noted that some forms of crystalline chromium deposited from hexavalent chromium baths contain sulfur, but the sulfur content of such chromium deposits is substantially lower than the sulfur content of the crystalline chromium deposits in accordance with the present invention.

In one embodiment, the crystalline chromium deposit contains from about 0.1 to about 5 wt % nitrogen. In another embodiment, the crystalline chromium deposit contains from about 0.5 to about 3 wt % nitrogen. In another embodiment the crystalline chromium deposit contains about 0.4 weight percent nitrogen.

In one embodiment, the crystalline chromium deposit contains from about 0.1 to about 5 wt % carbon. In another embodiment, the crystalline chromium deposit contains from about 0.5 to about 3 wt % carbon. In another embodiment the crystalline chromium deposit contains about 1.4 wt. % carbon. In one embodiment, the crystalline chromium deposit contains an amount of carbon less than that amount which renders the chromium deposit amorphous. That is, above a certain level, in one embodiment, above about 10 wt. %, the carbon renders the chromium deposit amorphous, and therefore takes it out of the scope of the present invention. Thus, the carbon content should be controlled so that it does not render the chromium deposit amorphous. The carbon may be present as elemental carbon or as carbide carbon. If the carbon is present as elemental, it may be present either as graphitic or as amorphous.

In one embodiment, the crystalline chromium deposit contains from about 1.7 wt. % to about 4 wt. % sulfur, from about 0.1 wt. % to about 5 wt. % nitrogen, and from about 0.1 wt. % to about 10 wt. % carbon.

The crystalline chromium deposit of the present invention is electrodeposited from a trivalent chromium electroplating bath. The trivalent chromium bath is substantially free of hexavalent chromium. In one embodiment, the bath is free of detectable amounts of hexavalent chromium. The trivalent chromium may be supplied as chromic chloride, $CrCl_3$, chromic fluoride, $CrF_3$, chromic nitrate, $Cr(NO_3)_3$, chromic oxide $Cr_2O_3$, chromic phosphate $CrPO_4$, or in a commercially available solution such as chromium hydroxy dichloride solution, chromic chloride solution, or chromium sulfate solution, e.g., from McGean Chemical Company or Sentury Reagents. Trivalent chromium is also available as chromium sulfate/sodium or potassium sulfate salts, e.g., $Cr(OH)SO_4.Na_2SO_4$, often referred to as chrometans or kromsans, chemicals often used for tanning of leather, and available from companies such as Elementis, Lancashire Chemical, and Soda Sanayii. As noted below, the trivalent chromium may also be provided as chromic formate, $Cr(HCOO)_3$ from Sentury Reagents.

The concentration of the trivalent chromium may be in the range from about 0.1 molar (M) to about 5 M. The higher the concentration of trivalent chromium, the higher the current density that can be applied without resulting in a dendritic deposit, and consequently the faster the rate of crystalline chromium deposition that can be achieved.

The trivalent chromium bath may further include an organic additive such as formic acid or a salt thereof, such as one or more of sodium formate, potassium formate, ammonium formate, calcium formate, magnesium formate, etc.

Other organic additives, including amino acids such as glycine and thiocyanate may also be used to produce crystalline chromium deposits from trivalent chromium and their use is within the scope of one embodiment of this invention. Chromium (III) formate, $Cr(HCOO)_3$, could also be used as a source of both trivalent chromium and formate.

The trivalent chromium bath may further include a source of nitrogen, which may be in the form of ammonium hydroxide or a salt thereof, or may be a primary, secondary or tertiary alkyl amine, in which the alkyl group is a $C_1$-$C_6$ alkyl. In one embodiment, the source of nitrogen is other than a quaternary ammonium compound. In addition to amines, amino acids, hydroxy amines such as quadrol and polyhydric alkanolamines, can be used as the source of nitrogen. In one embodiment of such nitrogen sources, the additives include $C_1$-$C_6$ alkyl groups. In one embodiment, the source of nitrogen may be added as a salt, e.g., an amine salt such as a hydrohalide salt.

As noted above, the crystalline chromium deposit may include carbon. The carbon source may be, for example, the organic compound such as formic acid or formic acid salt included in the bath. Similarly, the crystalline chromium may include oxygen and hydrogen, which may be obtained from other components of the bath including electrolysis of water, or may also be derived from the formic acid or salt thereof, or from other bath components.

In addition to the chromium atoms in the crystalline chromium deposit, other metals may be co-deposited. As will be understood by those of skill in the art, such metals may be suitably added to the trivalent chromium electroplating bath as desired to obtain various crystalline alloys of chromium in the deposit. Such metals include, but are not necessarily limited to, Re, Cu, Fe, W, Ni, Mn, and may also include, for example, P (phosphorus). In fact, all elements electrodepositable from aqueous solution, directly or by induction, as described by Pourbaix or by Brenner, may be alloyed in this process. In one embodiment, the alloyed metal is other than aluminum. As is known in the art, metals electrodepositable from aqueous solution include: Ag, As, Au, Bi, Cd, Co, Cr, Cu, Ga, Ge, Fe, In, Mn, Mo, Ni, P, Pb, Pd, Pt, Rh, Re, Ru, S, Sb, Se, Sn, Te, Tl, W and Zn, and inducible elements include B, C and N. As will be understood by those of skill in the art, the co-deposited metal or atom is present in an amount less than the amount of chromium in the deposit, and the deposit obtained thereby should be body-centered cubic crystalline, as is the crystalline chromium deposit of the present invention obtained in the absence of such co-deposited metal or atom.

The trivalent chromium bath further comprises a pH of at least 4.0, and the pH can range up to at least about 6.5. In one embodiment, the pH of the trivalent chromium bath is in the range from about 4.5 to about 6.5, and in another embodiment the pH of the trivalent chromium bath is in the range from about 4.5 to about 6, and in another embodiment, the pH of the trivalent chromium bath is in the range from about 5 to about 6, and in one embodiment, the pH of the trivalent chromium bath is about 5.5.

In one embodiment, the trivalent chromium bath is maintained at a temperature in the range from about 35° C. to about 115° C. or the boiling point of the solution, whichever is less, during the process of electrodepositing the crystalline chromium deposit of the present invention. In one embodiment, the bath temperature is in the range from about 45° C. to about 75° C., and in another embodiment, the bath temperature is in the range from about 50° C. to about 65° C., and in one embodiment, the bath temperature is maintained at about 55° C., during the process of electrodepositing the crystalline chromium deposit.

During the process of electrodepositing the crystalline chromium deposit of the present invention, the electrical current is applied at a current density of at least about 10 amperes per square decimeter (A/d $m^2$). In another embodiment, the current density is in the range from about 10 A/$dm^2$ to about 200 A/$dm^2$, and in another embodiment, the current density is in the range from about 10 A/$dm^2$ to about 100 A/$dm^2$, and in another embodiment, the current density is in the range from about 20 A/$dm^2$ to about 70 A/$dm^2$, and in another embodiment, the current density is in the range from about 30 A/$dm^2$ to about 60 A/$dm^2$, during the electrodeposition of the crystalline chromium deposit from the trivalent chromium bath in accordance with the present invention.

During the process of electrodepositing the crystalline chromium deposit of the present invention, the electrical current may be applied using any one or any combination of two or more of direct current, pulse waveform or pulse periodic reverse waveform.

Thus, in one embodiment, the present invention provides a process for electrodepositing a crystalline chromium deposit on a substrate, including steps of:

providing an aqueous electroplating bath comprising trivalent chromium, formic acid or a salt thereof and at least one source of divalent sulfur, and substantially free of hexavalent chromium;

immersing a substrate in the electroplating bath; and applying an electrical current to deposit a crystalline chromium deposit on the substrate, wherein the chromium deposit is crystalline as deposited.

In one embodiment, the crystalline chromium deposit obtained from this process has a lattice parameter of 2.8895+/−0.0025 Å. In one embodiment, the crystalline chromium deposit obtained from this process has a preferred orientation ("PO").

In another embodiment, the present invention provides a process for electrodepositing a crystalline chromium deposit on a substrate, including steps of:

providing an electroplating bath comprising trivalent chromium, formic acid and substantially free of hexavalent chromium;

immersing a substrate in the electroplating bath; and applying an electrical current to deposit a crystalline chromium deposit on the substrate, wherein the chromium deposit is crystalline as deposited and the crystalline chromium deposit has a lattice parameter of 2.8895+/−0.0025 Å. In one embodiment, the crystalline chromium deposit obtained from this has a {111} preferred orientation.

These processes in accordance with the invention may be carried out under the conditions described herein, and in accordance with standard practices for electrodeposition of chromium.

As noted above, a source of divalent sulfur is preferably provided in the trivalent chromium electroplating bath. A wide variety of divalent sulfur-containing compounds can be used in accordance with the present invention.

In one embodiment, the source of divalent sulfur may include one or a mixture of two or more of a compound having the general formula (I):

$$X^1—R^1—(S)_n—R^2—X^2 \quad (I)$$

wherein in (I), $X^1$ and $X^2$ may be the same or different and each of $X^1$ and $X^2$ independently comprise hydrogen, halogen, amino, cyano, nitro, nitroso, azo, alkylcarbonyl, formyl, alkoxycarbonyl, aminocarbonyl, alkylaminocarbonyl, dialkylaminocarbonyl, carboxyl (as used herein, "carboxyl" includes all forms of carboxyl groups, e.g., carboxylic acids, carboxylic alkyl esters and carboxylic salts), carboxylate, sulfonate, sulfinate, phosphonate, phosphinate, sulfoxide, carbamate, polyethoxylated alkyl, polypropoxylated alkyl, hydroxyl, halogen-substituted alkyl, alkoxy, alkyl sulfate ester, alkylthio, alkylsulfinyl, alkylsulfonyl, alkylphosphonate or alkylphosphinate, wherein the alkyl and alkoxy groups are $C_1$-$C_6$, or $X^1$ and $X^2$ taken together may form a bond from $R^1$ to $R^2$, thus forming a ring containing the $R^1$ and $R^2$ groups, wherein $R^1$ and $R^2$ may be the same or different and each of $R^1$ and $R^2$ independently comprise a single bond, alkyl, allyl, alkenyl, alkynyl, cyclohexyl, aromatic and heteroaromatic rings, alkoxycarbonyl, aminocarbonyl, alkylaminocarbonyl, dialkylaminocarbonyl, polyethoxylated and polypropoxylated alkyl, wherein the alkyl groups are $C_1$-$C_6$, and wherein n has an average value ranging from 1 to about 5.

In one embodiment, the source of divalent sulfur may include one or a mixture of two or more of a compound having the general formula (IIa) and/or (IIb):

(IIa)

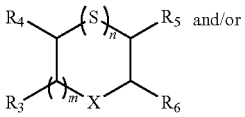

and/or (IIb)

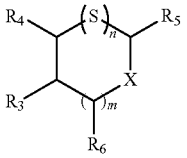

wherein in (IIa) and (IIb), $R_3$, $R_4$, $R_5$ and $R_6$ may be the same or different and independently comprise hydrogen, halogen, amino, cyano, nitro, nitroso, azo, alkylcarbonyl, formyl, alkoxycarbonyl, aminocarbonyl, alkylaminocarbonyl, dialkylaminocarbonyl, carboxyl, sulfonate, sulfinate, phosphonate, phosphinate, sulfoxide, carbamate, polyethoxylated alkyl, polypropoxylated alkyl, hydroxyl, halogen-substituted alkyl, alkoxy, alkyl sulfate ester, alkylthio, alkylsulfinyl, alkylsulfonyl, alkylphosphonate or alkylphosphinate, wherein the alkyl and alkoxy groups are $C_1$-$C_6$, wherein X represents carbon, nitrogen, oxygen, sulfur, selenium or tellurium and in which m ranges from 0 to about 3, wherein n has an average value ranging from 1 to about 5, and wherein each of (IIa) or (IIb) includes at least one divalent sulfur atom.

In one embodiment, the source of divalent sulfur may include one or a mixture of two or more of a compound having the general formula (IIIa) and/or (IIIb):

(IIIa)

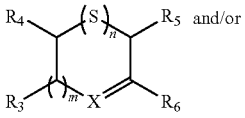

and/or

-continued (IIIb)

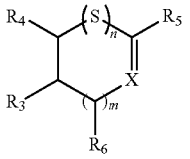

wherein, in (IIIa) and (IIIb), $R_3$, $R_4$, $R_5$ and $R_6$ may be the same or different and independently comprise hydrogen, halogen, amino, cyano, nitro, nitroso, azo, alkylcarbonyl, formyl, alkoxycarbonyl, aminocarbonyl, alkylaminocarbonyl, dialkylaminocarbonyl, carboxyl, sulfonate, sulfinate, phosphonate, phosphinate, sulfoxide, carbamate, polyethoxylated alkyl, polypropoxylated alkyl, hydroxyl, halogen-substituted alkyl, alkoxy, alkyl sulfate ester, alkylthio, alkylsulfinyl, alkylsulfonyl, alkylphosphonate or alkylphosphinate, wherein the alkyl and alkoxy groups are $C_1$-$C_6$, wherein X represents carbon, nitrogen, sulfur, selenium or tellurium and in which m ranges from 0 to about 3, wherein n has an average value ranging from 1 to about 5, and wherein each of (IIIa) or (IIIb) includes at least one divalent sulfur atom.

In one embodiment, in any of the foregoing sulfur containing compounds, the sulfur may be replaced by selenium or tellurium. Exemplary selenium compounds include seleno-DL-methionine, seleno-DL-cystine, other selenides, R—Se—R', diselenides, R—Se—Se—R' and selenols, R—Se—H, where R and R' independently may be an alkyl or aryl group having from 1 to about 20 carbon atoms, which may include other heteroatoms, such as oxygen or nitrogen, similar to those disclosed above for sulfur. Exemplary tellurium compounds include ethoxy and methoxy telluride, $Te(OC_2H_5)_4$ and $Te(OCH_3)_4$.

As will be understood, the substituents used are preferably selected so that the compounds thus obtained remain soluble in the electroplating baths of the present invention.

COMPARATIVE EXAMPLES

Hexavalent Chromium

In Table 1 comparative examples of various aqueous hexavalent chromic acid containing electrolytes that produce functional chromium deposits are listed, the crystallographic properties of the deposit tabulated, and reported elemental composition based upon C, O, H, N and S analysis.

TABLE 1

Hexavalent chromium based electrolytes for functional chromium

| | H1 | H2 | H3 | H4 | H5 | H6 |
|---|---|---|---|---|---|---|
| $CrO_3$ (M) | 2.50 | 2.50 | 2.50 | 2.50 | 2.50 | 8.00 |
| $H_2SO_4$ (M) | | 0.026 | 0.015 | 0.029 | | |
| $MgSiF_6$ (M) | | | 0.02 | | | |
| $CH_2(SO_3Na)_2$ (M) | | | | 0.015 | | |
| $KIO_3$ (M) | | | | | 0.016 | 0.009 |
| $HO_3SCH_2CO_2H$ (M) | | | | | 0.18 | |
| HCl (M) 11.7 N | | | | | | 0.070 |
| $H_2O$ | to 1 L | to 1 L | to 1 L | to 1 L | to 1 L | to 1 L |
| Current Density ($A/dm^2$) | 30 | 20 | 45 | 50 | 50 | 62 |

TABLE 1-continued

| Hexavalent chromium based electrolytes for functional chromium | H1 | H2 | H3 | H4 | H5 | H6 |
|---|---|---|---|---|---|---|
| Temperature, ° C. | 55 | 55 | 50 | 60 | 55 | 50 |
| Cathodic efficiency, % | 2-7 | 10-15 | 15-25 | 20-30 | 35-40 | 55-60 |
| Lattice(s) | BCC | BCC | BCC | BCC | BCC-SC | BCC |
| Grain Preferred Orientation | Random | (222) PO | (222) (211) PO | (222) PO | (110) PO | Random |
| Lattice parameter as deposited | 2.883 | 2.882 | 2.883 | 2.881 | 2.882 | 2.886 |
| Bulk [C] at % | | — | — | 0.04 | 0.06 | |
| Bulk [H] at % | | 0.055 | 0.078 | 0.076 | 0.068 | |
| Bulk [$O_2$] at % | | 0.36 | 0.62 | 0.84 | 0.98 | |
| Bulk [S] at % | | — | — | 0.04 | 0.12 | |

In Table 2 comparative examples of trivalent chromium process solutions deemed by the Ecochrome project to be the best available technology are tabulated. The Ecochrome project was a multiyear European Union sponsored program (G1RD CT-2002-00718) to find an efficient and high performance hard chromium alternative based upon trivalent chromium (see, Hard Chromium Alternatives Team (HCAT) Meeting, San Diego, Calif., Jan. 24-26, 2006). The three processes are from Cidetec, a consortium based in Spain; ENSME, a consortium based in France; and, Musashi, a consortium based in Japan. In this table, where no chemical formula is specifically listed, the material is believed to be proprietary in the presentations from which these data were obtained, and is not available.

TABLE 2

| Best available known technology for functional trivalent chromium processes from the Ecochrome project. | EC1 (Cidetec) | EC2 (ENSME) | EC3 (Musashi) |
|---|---|---|---|
| Cr (III) (M) | 0.40 | 1.19 | |
| $CrCl_3 \cdot 6H_2O$ (M) from $Cr(OH)_3$ + 3HCl | | | 1.13 |
| $H_2NCH_2CO_2H$ (M) | | | 0.67 |
| Ligand 1 (M) | 0.60 | | |
| Ligand 2 (M) | 0.30 | | |
| Ligand 3 (M) | 0.75 | | |
| $H_3BO_3$ (M) | 0.75 | | |
| Conductivity salts (M) | 2.25 | | |
| $HCO_2H$ (M) | | 0.19 | |

TABLE 2-continued

| Best available known technology for functional trivalent chromium processes from the Ecochrome project. | EC1 (Cidetec) | EC2 (ENSME) | EC3 (Musashi) |
|---|---|---|---|
| $NH_4Cl$ (M) | | 0.19 | 2.43 |
| $H_3BO_3$ (M) | | 0.08 | 0.42 |
| $AlCl_3 \cdot 6H_2O$ (M) | | | 0.27 |
| Surfactant ml/L | 0.225 | 0.2 | |
| pH | 2-2.3 | ~0.1 | ~0.3 |
| Temp (° C.) | 45-50 | 50 | 50 |
| Current density A/dm$^2$ | 20.00 | 70.00 | 40.00 |
| Cathodic efficiency | 10% | ~27% | 13% |
| Structure as plated | amorphous | amorphous | amorphous |
| Orientation | NA | NA | NA |

In the Table 2 comparative examples, the EC3 example contains aluminum chloride. Other trivalent chromium solutions containing aluminum chloride have been described. Suvegh et al. (Journal of Electroanalytical Chemistry 455 (1998) 69-73) use an electrolyte comprising 0.8 M $[Cr(H_2O)_4Cl_2]Cl.2H_2O$, 0.5 M $NH_4Cl$, 0.5 M NaCl, 0.15 M $H_3BO_3$, 1 M glycine, and 0.45 M $AlCl_3$, pH not described. Hong et al. (Plating and Surface Finishing, March 2001) describe an electrolyte comprising mixtures of carboxylic acids, a chromium salt, boric acid, potassium chloride, and an aluminum salt, at pH 1-3). Ishida et al. (Journal of the Hard Chromium Platers Association of Japan 17, No. 2, Oct. 31, 2002) describe solutions comprising 1.126 M $[Cr(H_2O)_4Cl_2]Cl.2H_2O$, 0.67 M glycine, 2.43 M $NH_4Cl$, and 0.48 M $H_3BO_3$ to which varying amounts of $AlCl_3.6H_2O$, from 0.11 to 0.41 M were added; pH was not described. Of these four references disclosing aluminum chloride in the trivalent chromium bath, only Ishida et al. contends that the chromium deposit is crystalline, stating that crystalline deposits accompany increasing concentrations of $AlCl_3$. However, repeated attempts by the present inventors to replicate the experiment and produce crystalline deposits have failed. It is believed that an important experimental variable is not described by Ishida et al. Therefore, it is considered that Ishida et al. fails to teach how to make a reliably consistent crystalline chromium deposit.

In Table 3 various aqueous ("T") trivalent chromium-containing electrolytes and one ionic liquid ("IL") trivalent chromium-containing electrolyte, all of which can produce chromium deposits in excess of one micron thickness, are listed and the crystallographic properties of the deposit tabulated.

TABLE 3

| Trivalent chromium based electrolytes for functional chromium | T1 | T2 | T3 | T4 | T5 | T6 | T7 | IL1 | MW |
|---|---|---|---|---|---|---|---|---|---|
| $Cr(OH)SO_4 \cdot Na_2SO_4$ (M) | 0.39 | 0.39 | 0.39 | 0.55 | 0.39 | | | | 307 |
| KCl (M) | 3.35 | | | | | | | | 74.55 |
| $H_3BO_3$ (M) | 1.05 | | | | | | | | 61.84 |
| $HCO_2^-K^+$ (M) | 0.62 | | | | | | | | 84.1 |
| $CrCl_3 \cdot 6H2O$ (M) | | | | | | | 1.13 | 2.26 | 266.4 |
| $Cr(HCO_2)_3$ (M) | | | | | | 0.38 | | | 187 |
| $CH_2OHCH_2$ | | | | | | | | 2.13 | 139.5 |

TABLE 3-continued

| Trivalent chromium based electrolytes for functional chromium | | | | | | | | | |
|---|---|---|---|---|---|---|---|---|---|
| | T1 | T2 | T3 | T4 | T5 | T6 | T7 | IL1 | MW |
| $N^+(CH_3)_3Cl^-$ (M) | | | | | | | | | |
| $NH_4CHO_2$ (M) | | 3.72 | | | | | 5.55 | | 63.1 |
| LiCl (M) | | | | | | | | 2.36 | 42.4 |
| $HCO_2H$ (M) | | | 3.52 | 3.03 | 3.52 | 0.82 | 4.89 | | 46.02 |
| $NH_4OH$ (M) | | | 5.53 | 4.19 | 5.53 | | | | 35 |
| $(NH_4)_2SO_4$ (M) | | 0.61 | 0.61 | | | 1.18 | | | 132.1 |
| $NH_4Cl$ (M) | | 0.56 | 0.56 | 1.87 | 0.56 | 0.56 | | | 53.5 |
| $NH_4Br$ (M) | | 0.10 | 0.10 | 0.51 | 0.10 | 0.10 | 0.10 | | 97.96 |
| $Na_4P_2O_7 \cdot 10 H_2O$ (M) | | 0.034 | 0.034 | | | 0.034 | | | 446 |
| KBr (M) | 0.042 | | | | | | | | 119 |
| $H_2O$ | to 1 L | to 1 L | to 1 L | to 1 L | to 1 L | to 1 L | to 1 L | none | 18 |
| pH | 0.1-3 | 0.1-3 | 0.1-3 | 0.1-3 | 0.1-3 | 0.1-3 | 0.1-3 | NA | |
| Current density ($A/dm^2$) | 12.4 | 20 | 20 | 20 | 20 | 50 | 80 | | |
| Temp. ° C. | 45 | 45 | 45 | 45 | 45 | 45 | 45 | 80 | |
| Cathodic eff. | 25% | 15% | 15% | 15% | 15% | 30% | | ~10% | |
| Lattice(s) | Amor. | Amor. | Amor. | Amor. | Amor. | Amor. | NA | SC | |
| Grain Pref. Orientation | NA | NA | NA | NA | NA | Pwdr | Pwdr | Rndm | |
| Lattice parameter after anneal 4 hr./191° C. | 2.882 | 2.884 | 2.882 | 2.886 | 2.883 | NA | NA | — | |
| Organic additives pH > 4 | Amor. | xtal. | xtal. | xtal. | xtal. | xtal. | xtal. | — | |
| Grain Orientation | | (111), Rndm | (111), Rndm | (111), Rndm | (111), Rndm | (111), Rndm | (111), Rndm | | |
| Electrolyte + $AlCl_3 \cdot 6H_2O$ 0.62 M, pH < 3 | Amor. | xtal. | xtal. | xtal. | xtal. | xtal. | xtal. | | |

In Table 3: Pwdr = powder; Amor. = amorphous; rndm = random; NA = not applicable; SC = simple cubic; xtal. = crystalline In Table 4 the various deposits from Tables 1, 2 and 3 are compared using standard test methods frequently used for evaluation of as-deposited functional chromium electrodeposits. From this table it can be observed that amorphous deposits, and deposits that are not BCC (body centered cubic) do not pass all the necessary initial tests.

TABLE 4

Comparison of test results on as deposited functional chromium from electrolytes in tables 1-3

| Electrolyte | Structure | Orientation | Appearance | Grind test | Macro-crack after heating | Hardness Vickers (100 g) | Cracks from indentation? |
|---|---|---|---|---|---|---|---|
| H1 | BCC | random | powdery | fail | Yes | — | — |
| H2 | BCC | (222) | lustrous | pass | No | 900 | No |
| H3 | BCC | (222)(211) | lustrous | pass | No | 950 | No |
| H4 | BCC | (222) | lustrous | pass | No | 950 | No |
| H5 | BCC + SC | (222)(110) | lustrous | fail | No | 900 | No |
| H6 | BCC | random. | lustrous | fail | No | 960 | Yes |
| EC1 | amor. | NA | lustrous | fail | Yes | 845-1000 | Yes |
| EC2 | amor. | NA | lustrous | fail | Yes | 1000 | Yes |
| EC3 | amor. | NA | lustrous | fail | Yes | — | Yes |
| T1 | amor. | NA | lustrous | fail | Yes | 1000 | Yes |
| T2 | amor. | NA | lustrous | fail | Yes | 950 | Yes |
| T3 | amor. | NA | lustrous | fail | Yes | 950 | Yes |
| T4 | amor. | NA | lustrous | fail | Yes | 900 | Yes |
| T5 | amor. | NA | lustrous | fail | Yes | 1050 | No |
| T6 | amor. | NA | lustrous | fail | Yes | 950 | Yes |

TABLE 4-continued

Comparison of test results on as deposited functional chromium from electrolytes in tables 1-3

| Electro-lyte | Structure | Orien-tation | Appear-ance | Grind test | Macro-crack after heating | Hardness Vickers (100 g) | Cracks from indenta-tion? |
|---|---|---|---|---|---|---|---|
| T7 | powdery | — | — | — | — | — | — |
| IL1 | SC | random | black particulate | fail | Yes | — | — |

In accordance with industrial requirements for replacement of hexavalent chromium electrodeposition baths, the deposits from trivalent chromium electrodeposition baths must be crystalline to be effective and useful as a functional chromium deposit. It has been found that certain additives can be used together with adjustments in the process variables of the electrodeposition process to obtain a desirably crystalline chromium deposit from a trivalent chromium bath that is substantially free of hexavalent chromium. Typical process variables include current density, solution temperature, solution agitation, concentration of additives, manipulation of the applied current waveform, and solution pH. Various tests may be used to accurately assess the efficacy of a particular additive, including, e.g., X-ray diffraction (XRD) (to study the structure of the chromium deposit), X-ray photoelectron spectroscopy (XPS) (for determination of components of the chromium deposit, greater than about 0.2-0.5 wt. %), elastic recoil determination (ERD)(for determination of hydrogen content), and electron microscopy (for determination of physical or morphological characteristics such as cracking).

In the prior art, it has been generally and widely considered that chromium deposition from trivalent chromium baths must occur at pH values less than about 2.5. However, there are isolated trivalent chromium plating processes, including brush plating processes, where higher pH's have been used, although the higher pH's used in these brush plating solutions do not result in a crystalline chromium deposit. Therefore, in order to assess the efficacy of various additives, stable, high pH electrolytes were tested as well as the commonly accepted low pH electrolytes.

TABLE 5

Additives inducing crystallization from trivalent chromium bath T2.

| Additive | Concentration Range Added | T2 pH 2.5: Crystalline? | T2 pH 4.2: Crystalline? |
|---|---|---|---|
| Methionine | 0.1, 0.5, 1.0, 1.5 g/L | no | no, yes, yes, na |
| Cystine | 0.1, 0.5, 1.0, 1.5 g/L | no | yes, yes, yes, yes |
| Thiomorpholine | 0.1, 0.5, 1, 1.5, 2, 3 mL/L | no | no, no, yes, yes, yes, yes |
| Thiodipropionic Acid | 0.1, 0.5, 1.0, 1.5 g/L | no | no, yes, yes, yes |
| Thiodiethanol | 0.1, 0.5, 1.0, 1.5 g/L | no | no, yes, yes, yes |
| Cysteine | 0.1, 1, 2.0, 3.0 g/L | no | yes, yes, yes, yes, |
| Allyl Sulfide | 0.5, 1.0, 1.5 mL/L | no | no, yes, yes, na |
| Thiosalicylic Acid | 0.5, 1, 1.5 | no | yes, yes, yes |
| 3,3'-dithio-dipropanoic acid | 1, 2, 5, 10 g/L | no | yes, yes, yes, yes, |
| Tetrahydro-thiophene | 0.5, 1.0, 1.5 mL/L | no | no, yes, yes |

From the data shown in Table 5 it is apparent that compounds that have divalent sulfur in their structure induce crystallization when chromium is electrodeposited from a trivalent chromium solution, at about the above-stated concentrations and when the pH of the bath is greater than about 4, in which the chromium crystals have the lattice parameter of 2.8895+/−0.0025 Å, in accordance with the present invention. In one embodiment, other divalent sulfur compounds can be used in the baths described herein to electrodeposit crystalline chromium having the lattice parameter of the present invention. In one embodiment, compounds having sulfur, selenium or tellurium, when used as described herein, also induce crystallization of chromium. In one embodiment, the selenium and tellurium compounds correspond to the above-identified sulfur compounds, and like the sulfur compounds, result in the electrodeposition of crystalline chromium having a lattice parameter of 2.8895+/−0.0025 Å.

To further illustrate the induction of crystallization, studies on crystallization inducing additives using electrolyte T3 at pH 5.5 and temperature 50° C. with identical cathode current densities of 40 A/dm$^2$ and plating times of thirty minutes using brass substrate are reported in Table 6. After plating is complete the coupons are examined using X-ray diffraction, X-ray induced X-ray fluorescence for thickness determination, and electron induced X-ray fluorescence with an energy dispersive spectrophotometer to measure sulfur content. Table 6 summarizes the data. The data may suggest that it is not only the presence of a divalent sulfur compound in the solution at a concentration exceeding a threshold concentration that induces crystallization but the presence of sulfur in the deposit, as well.

TABLE 6

Induction of sulfur from various divalent sulfur additives and the effects on as-plated crystallization of Cr for Cr +3 solution, and plating rate.

| Additive | Additive per L | Crystalline | Thickness (um) | [S] wt % in deposit |
|---|---|---|---|---|
| Methionine | 0.1 g | no | 3.13 | 2.1 |
| | 0.5 g | yes | 2.57 | 4.3 |
| | 1.0 g | yes | 4.27 | 3.8 |
| | 1.5 g | (insoluble) | 7.17 | 2.6 |
| Cystine | 0.1 g | yes | 1.62 | 3.9 |
| | 0.5 g | yes | 0.75 | 7.1 |
| | 10 g | yes | 1.39 | 9.3 |
| | 1.5 g | yes | 0.25 | 8.6 |
| Thiomorpholine | 0.1 mL | no | 6.87 | 1.7 |
| | 0.5 mL | no | 11.82 | 3.9 |
| | 1 mL | yes | 7.7 | 5.9 |
| | 1.5 mL | yes | 2.68 | 6.7 |
| | 2 mL | yes | 4.56 | 7.8 |
| | 3 mL | yes | 6.35 | 7.1 |

TABLE 6-continued

Induction of sulfur from various divalent sulfur additives and the effects on as-plated crystallization of Cr for Cr +3 solution, and plating rate.

| Additive | Additive per L | Crystalline | Thickness (um) | [S] wt % in deposit |
|---|---|---|---|---|
| Thiodipropionic Acid | 0.1 g | no | 6.73 | 1 |
| | 0.5 g | yes | 4.83 | 3.5 |
| | 1.0 g | yes | 8.11 | 1.8 |
| | 1.5 g | yes | 8.2 | 3.1 |
| Thiodiethanol | 0.1 mL | no | 4.88 | 0.8 |
| | 0.5 mL | yes | 5.35 | 4 |
| | 1.0 mL | yes | 6.39 | 4 |
| | 1.5 mL | yes | 3.86 | 4.9 |
| Cysteine | 0.1 g | yes | 2.08 | 5.1 |
| | 1.0 g | yes | 1.3 | 7.5 |
| | 2.0 g | yes | 0.35 | 8.3 |
| | 3.0 g | yes | 0.92 | 9.7 |
| Allyl Sulfide (oily) | 0.1 mL | no | 6.39 | 1.3 |
| | 0.5 mL | yes | 4.06 | 3.4 |
| | 1.0 mL | yes | 1.33 | 4.9 |
| | 1.5 mL | (insoluble) | 5.03 | 2.6 |
| Thiosalicylic Acid | 0.5 g | yes | 2.09 | 5.8 |
| | 1.0 g | yes | 0.52 | 5.5 |
| | 1.5 g | yes | 0.33 | 7.2 |
| | 1.5 g | yes | 0.33 | 7.2 |
| 3,3'-thiodipropanoic acid | 1 g | yes | 7.5 | 5.9 |
| | 2 g | yes | 6 | 6.1 |
| | 5 g | yes | 4 | 6 |
| | 10 g | yes | 1 | 6.2 |

S content determined by EDS
"(insoluble)" means the additive was saturated at the given concentration The following Table 7 provides additional data relating to electroplating baths of trivalent chromium in accordance with the present invention.

The above examples are prepared with direct current and without the use of complex cathodic waveforms such as pulse or periodic reverse pulse plating, although such variations on the applied electrical current are within the scope of the present invention. All of the examples in Table 7 that are crystalline have a lattice constant of 2.8895+/−0.0025 Å, as deposited.

In a further example of the utility of this invention pulse depositions are performed using simple pulse waveforms generated with a Princeton Applied Research Model 273A galvanostat equipped with a power booster interface and a Kepco bipolar +/−10 A power supply, using process P1, with and without thiomorpholine. Pulse waveforms are square wave, 50% duty cycle, with sufficient current to produce a 40 A/dm$^2$ current density overall. The frequencies employed are 0.5 Hz, 5 Hz, 50 Hz, and 500 Hz. At all frequencies the deposits from process P1 without thiomorpholine are amorphous while the deposits from process P1 with thiomorpholine are crystalline as deposited.

In a further example of the utility of this invention pulse depositions are performed using simple pulse waveforms generated with a Princeton Applied Research Model 273A galvanostat equipped with a power booster interface and a Kepco bipolar +/−10 A power supply, using process P1, with and without thiomorpholine. Pulse waveforms are square wave, 50% duty cycle, with sufficient current to produce a 40 A/dm$^2$ current density overall. The frequencies employed are 0.5 Hz, 5 Hz, 50 Hz, and 500 Hz. At all frequencies the deposits from process P1 without thiomorpholine are amorphous while the deposits from process P1 with thiomorpholine are crystalline as deposited, and have a lattice constant of 2.8895+/−0.0025 Å.

TABLE 7

Representative formulations for production of as-deposited crystalline Cr from solutions of Cr+3.

| Process | Electrolyte | Additive | pH-° C.-A/dm$^2$ | Cathode Efficiency | preferred orientation | $H_v$ | [C] | [S] | [N]] |
|---|---|---|---|---|---|---|---|---|---|
| P1 | T2 | 4 ml/L thiomorpholine | 5.5-50-40 | 5-10% | (222) | 900-980 | 3.3 | 1.57 | 0.6 |
| P2 | T2 | 3 ml/L thiodiethanol | 5.5-50-40 | 10% | Random and (222) | — | 3.0 | 1.4 | 0.6 |
| P3 | T2 | 1 g/L l-cysteine | 5.5-50-40 | 5% | Random and (222) | — | | | |
| P4 | T5 | 4 ml/L thiomorpholine | 5.5-50-40 | 5-10% | (222) | 900-980 | | | |
| P5 | T5 | 3 ml/L thiodiethanol | 5.5-50-40 | 10% | Random and (222) | — | | | |
| P6 | T5 | 1 g/L l-cysteine | 5.5-50-40 | 5% | Random and (222) | — | | | |
| P7 | T5 | 4 ml/L thiomorpholine | 5.5-50-40 | 15% | (222) | 900-980 | | | |
| P8 | T5 | 3 ml/L thiodiethanol | 5.5-50-40 | 10-12% | Random and (222) | — | | | |
| P9 | T5 | 1 g/L l-cysteine | 5.5-50-40 | 7-9% | Random and (222) | — | | | |
| P10 | T5 | 2 g/L thiosalicylic acid | 5.5-50-40 | 10-12% | (222) | 940-975 | 5.5 | 1.8 | 1.3 |
| P11 | T5 | 2 g/L 3,3'-dithiodipropanoic acid | 5.5-50-40 | 12-15% | (222) | 930-980 | 4.9 | 2.1 | 1.1 |

Similarly the electrolyte T5 is tested with and without thiosalicylic acid at a concentration of 2 g/L using a variety of pulse waveforms having current ranges of 66-109 A/dm$^2$ with pulse durations from 0.4 to 200 ms and rest durations of 0.1 to 1 ms including periodic reverse waveforms with reverse current of 38-55 A/dm$^2$ and durations of 0.1 to 2 ms. In all cases, without thiosalicylic acid the deposit is amorphous, with thiosalicylic acid the deposit is crystalline, and has a lattice constant of 2.8895+/−0.0025 Å.

In one embodiment, the crystalline chromium deposits are homogeneous, without the deliberate inclusion of particles, and have a lattice constant of 2.8895+/−0.0025 Å. For example, particles of alumina, Teflon, silicon carbide, tungsten carbide, titanium nitride, etc. may be used with the present invention to form crystalline chromium deposits including such particles within the deposit. Use of such particles with the present invention is carried out substantially in the same manner as is known from prior art processes.

The foregoing examples use anodes of platinized titanium. However, the invention is in no way limited to the use of such anodes. In one embodiment, a graphite anode may be used as an insoluble anode. In another embodiment, a soluble chromium or ferrochromium anodes may be used.

In one embodiment, the anodes may be isolated from the bath. In one embodiment, the anodes may be isolated by use of a fabric, which may be either tightly knit or loosely woven. Suitable fabrics include those known in the art for such use, including, e.g., cotton and polypropylene, the latter available from Chautauqua Metal Finishing Supply, Ashville, N.Y. In another embodiment, the anode may be isolated by use of anionic or cationic membranes, for example, such as perfluorosulfonic acid membranes sold under the tradenames NAFION® (DuPont), ACIPLEX® (Asahi Kasei), FLEMION® (Asahi Glass) or others supplied by Dow or by Membranes International Glen Rock, N.J. In one embodiment, the anode may be placed in a compartment, in which the compartment is filled with an acidic, neutral, or alkaline electrolyte that differs from the bulk electrolyte, by an ion exchange means such as a cationic or anionic membrane or a salt bridge.

FIG. 1 includes three X-ray diffraction patterns (Cu k alpha) of crystalline chromium deposited in accordance with an embodiment of the present invention and with hexavalent chromium of the prior art. These X-ray diffraction patterns include, at the bottom and the center, a crystalline chromium deposited from trivalent chromium electrolyte T5 with 2 g/L (bottom) and 10 g/L (center) of 3,3'-dithiodipropanoic (DTDP) acid in the trivalent chromium bath, respectively. Each of these samples were deposited with a similar deposition time and current density. The top sample, in contrast, is a conventional chromium deposit from hexavalent electrolyte H4 (as described above). As shown in the top and bottom scans, for both the hexavalent chromium and the 2 g/l DTDP case, the absence of brass substrate peaks (identified by (*) for the center scan; see also FIG. 9 and text relating thereto) indicate thick deposits, greater than ~20 microns (the penetration depth of Cu k alpha radiation through chromium). In contrast, the presence of the brass peaks in the 10 g/L DTDP case shows that excess DTDP may diminish cathodic efficiency. In both DTDP cases however, the strong and broad (222) reflection demonstrates strong {111} preferred orientation is present and that the continuously diffracting domains of the chromium, generally thought to correlate with grain size, are very small, and are similar to chrome from hexavalent process H4.

Figure 2:
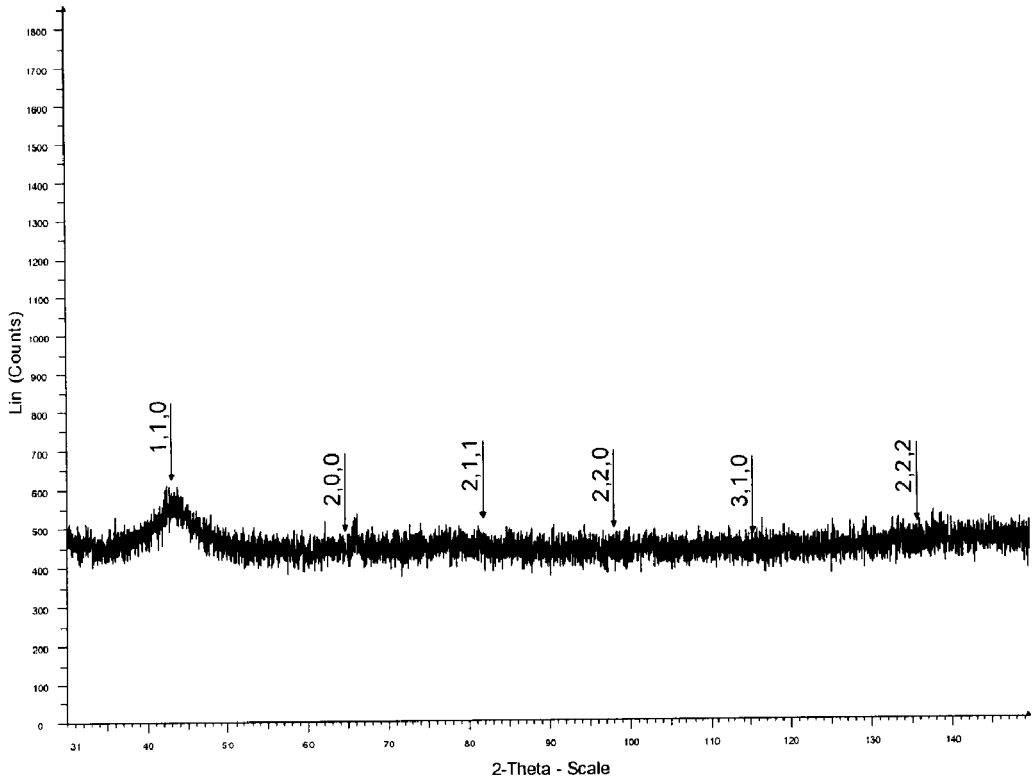
FIG. 2 is a typical X-ray diffraction pattern (Cu k alpha) of amorphous chromium from a trivalent chromium bath of the prior art.

FIG. 2 is a typical X-ray diffraction pattern (Cu k alpha) of amorphous chromium from a trivalent chromium bath of the prior art. As shown in FIG. 2, there are no sharp peaks corresponding to regularly occurring positions of atoms in the structure, which would be observed if the chromium deposit were crystalline.

Figure 3:
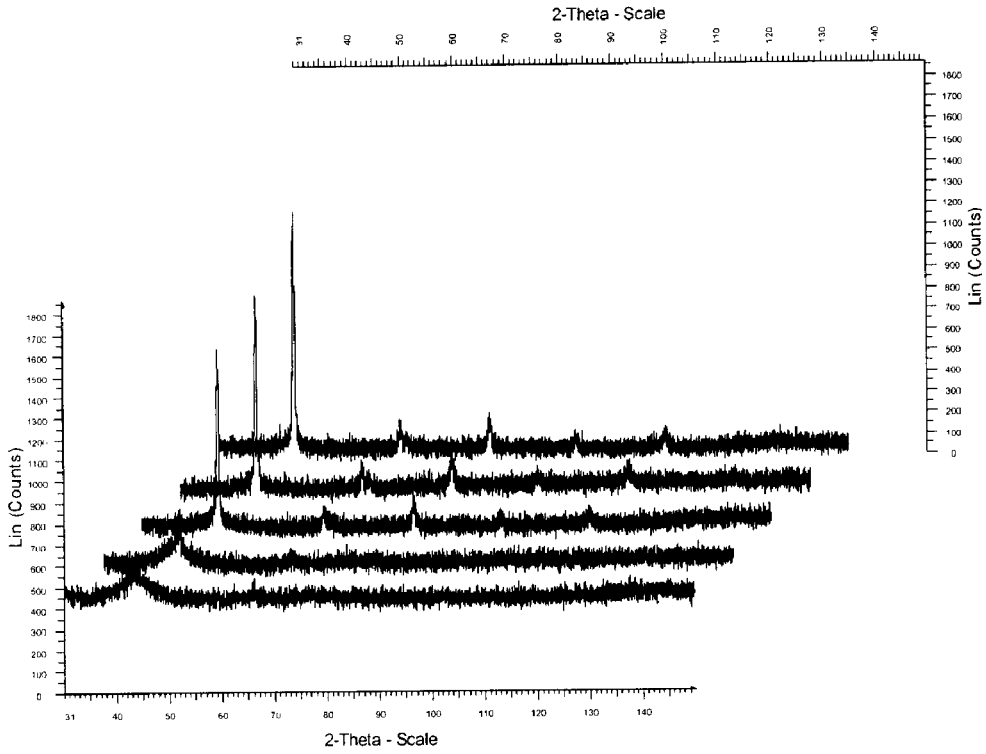
FIG. 3 is a typical X-ray diffraction pattern (Cu k alpha) showing the progressive effect of annealing an amorphous chromium deposit from a trivalent chromium bath of the prior art.

FIG. 3 is a series of typical X-ray diffraction pattern (Cu k alpha) showing the progressive effect of annealing an amorphous chromium deposit from a trivalent chromium bath of the prior art, containing no sulfur. In FIG. 3 there is shown a series of X-ray diffraction scans, starting at the lower portion and proceeding upward in FIG. 3, as the chromium deposit is annealed for longer and longer periods of time. As shown in FIG. 3, initially, the amorphous chromium deposit results in an X-ray diffraction pattern similar to that of FIG. 2, but with continued annealing, the chromium deposit gradually crystallizes, resulting in a pattern of sharp peaks corresponding to the regularly occurring atoms in the ordered crystal structure. The lattice parameter of the annealed chromium deposit is in the 2.882 to 2.885 range, although the quality of this series is not good enough to measure accurately.

Figure 4:
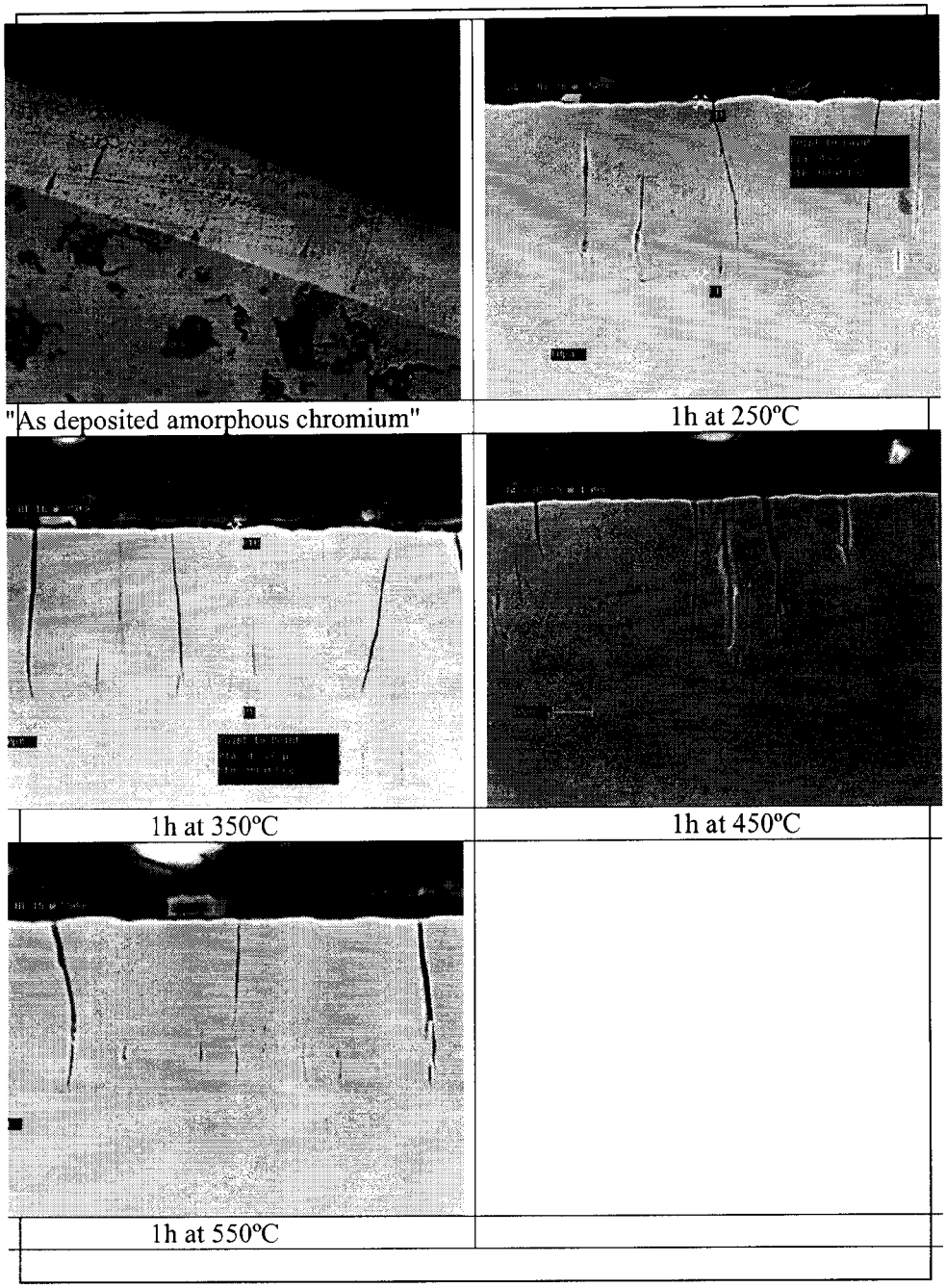
FIG. 4 is a series of electron photomicrographs showing the macrocracking effect of annealing an initially amorphous chromium deposit from a trivalent chromium bath of the prior art.

FIG. 4 is a series of electron photomicrographs showing the macrocracking effect of annealing an initially amorphous chromium deposit from a trivalent chromium bath of the prior art. In the photomicrograph labeled "As deposited amorphous chromium" the chromium layer is the lighter-colored layer deposited on the mottled-appearing substrate. In the photomicrograph labeled "1 h at 250° C.", after annealing at 250° C. for one hour, macrocracks have formed, while the chromium deposit crystallizes, the macrocracks extend through the thickness of the chromium deposit, down to the substrate. In this and the subsequent photomicrographs, the interface between the chromium deposit and the substrate is the faint line running roughly perpendicular to the direction of propagation of the macrocracks, and is marked by the small black square with "P1" within. In the photomicrograph labeled "1 h at 350° C.", after annealing at 350° C. for one hour, larger and more definite macrocracks have formed (compared to the "1 h at 250° C." sample), while the chromium deposit crystallizes, the macrocracks extend through the thickness of the chromium deposit, down to the substrate. In the photomicrograph labeled "1 h at 450° C.", after annealing at 450° C. for one hour, the macrocracks have formed and are larger than the lower temperature samples, while the chromium deposit crystallizes, the macrocracks extend through the thickness of the chromium deposit, down to the substrate. In the photomicrograph labeled "1 h at 550° C.", after annealing at 550° C. for one hour, the macrocracks have formed and appear to be larger yet than the lower temperature samples, while the chromium deposit crystallizes, the macrocracks extend through the thickness of the chromium deposit, down to the substrate.

Figure 5:
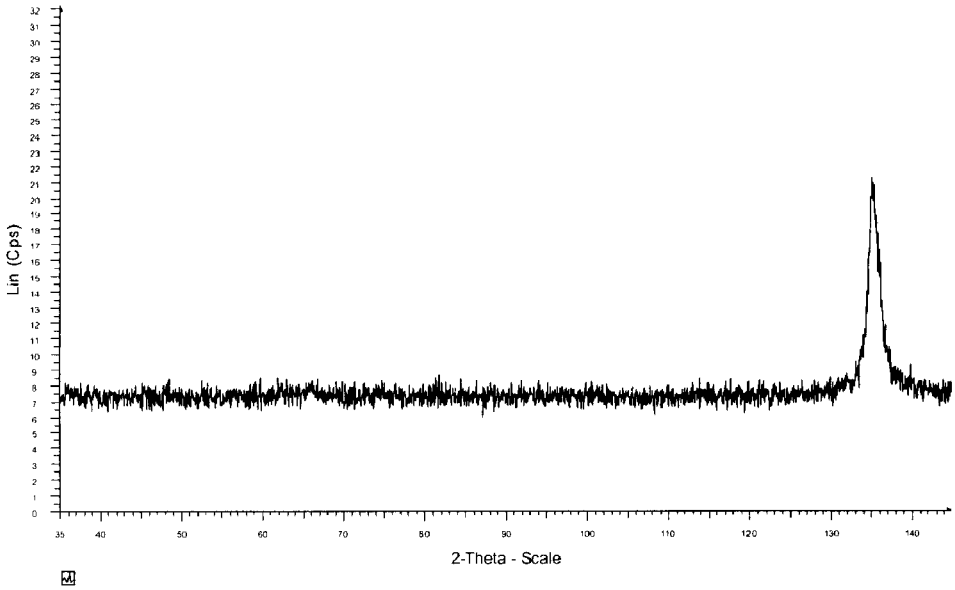
FIG. 5 is a typical X-ray diffraction pattern (Cu k alpha) of a crystalline as-deposited chromium deposit in accordance with an embodiment of the present invention.

FIG. 5 shows a typical X-ray diffraction pattern (Cu k alpha) of a crystalline as-deposited chromium deposit in accordance with the present invention. As shown in FIG. 5, the X-ray diffraction peaks are sharp and well defined, showing that the chromium deposit is crystalline, in accordance with the invention.

Figure 6:
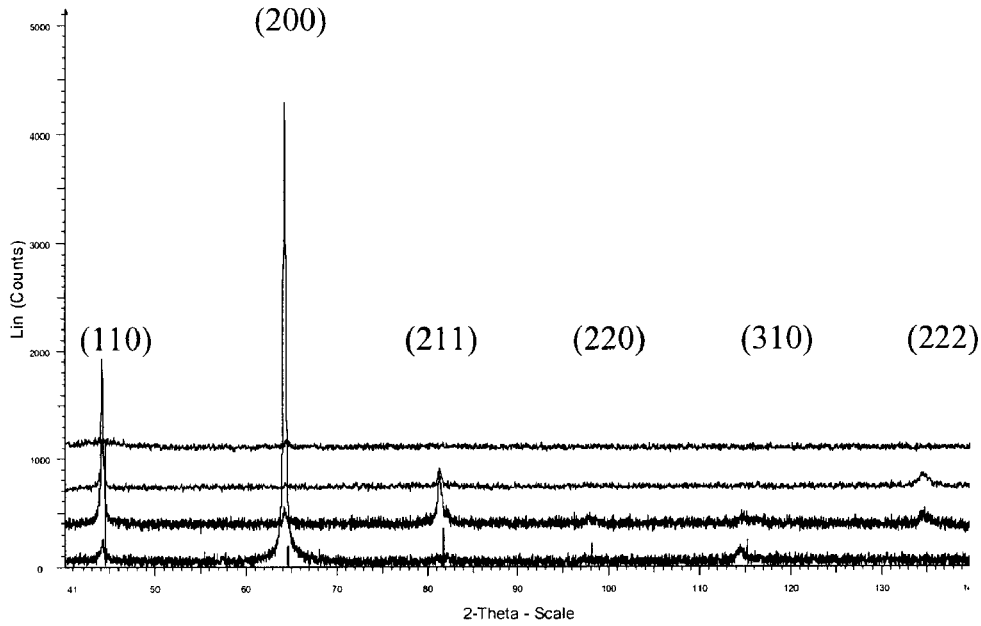
FIG. 6 is a series of typical X-ray diffraction patterns (Cu k alpha) of crystalline chromium deposits in accordance with embodiments of the present invention.

FIG. 6 shows typical X-ray diffraction patterns (Cu k alpha) of crystalline chromium deposits in accordance with the present invention. The middle two X-ray diffraction patterns shown in FIG. 6 demonstrate strong (222) peaks indicating the {111} preferred orientation (PO) similar to that observed with crystalline chromium deposited from a hexavalent chromium bath. The top and bottom X-ray diffraction patterns shown in FIG. 6 include (200) peaks indicating preferred orientations observed for other crystalline chromium deposits.

Figure 7:
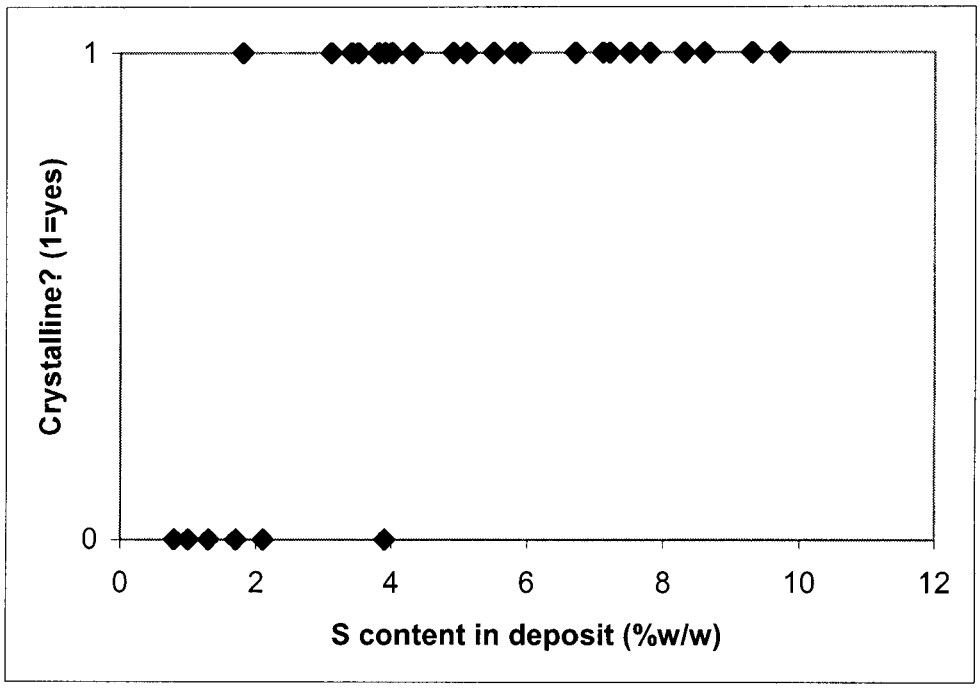
FIG. 7 is a graphical chart illustrating how the concentration of sulfur in one embodiment of a chromium deposit relates to the crystallinity of the chromium deposit.

FIG. 7 is a graphical chart illustrating how the concentration of sulfur in one embodiment of a chromium deposit relates to the crystallinity of the chromium deposit. In the graph shown in FIG. 7, if the deposit is crystalline, the crystallinity axis is assigned a value of one, while if the deposit is amorphous, the crystallinity axis is assigned a value of zero. Thus, in the embodiment shown in FIG. 7, where the sulfur content of the chromium deposit ranges from about 1.7 wt. % to about 4 wt. %, the deposit is crystalline, while outside this range, the deposit is amorphous. It is noted in this regard, that the amount of sulfur present in a given crystalline chromium deposit can vary. That is, in some embodiments, a crystalline chromium deposit may contain, for example, about 1 wt. % sulfur and be crystalline, and in other embodiments, with this sulfur content, the deposit would be amorphous (as in FIG. 7). In other embodiments, a higher sulfur content, for example, up to about 10 wt. %, might be found in a chromium deposit that is crystalline, while in other embodiments, if the sulfur content is greater than 4 wt. %, the deposit may be amorphous. Thus, sulfur content is important, but not controlling and not the only variable affecting the crystallinity of the trivalent-derived chromium deposit.

Figure 8:
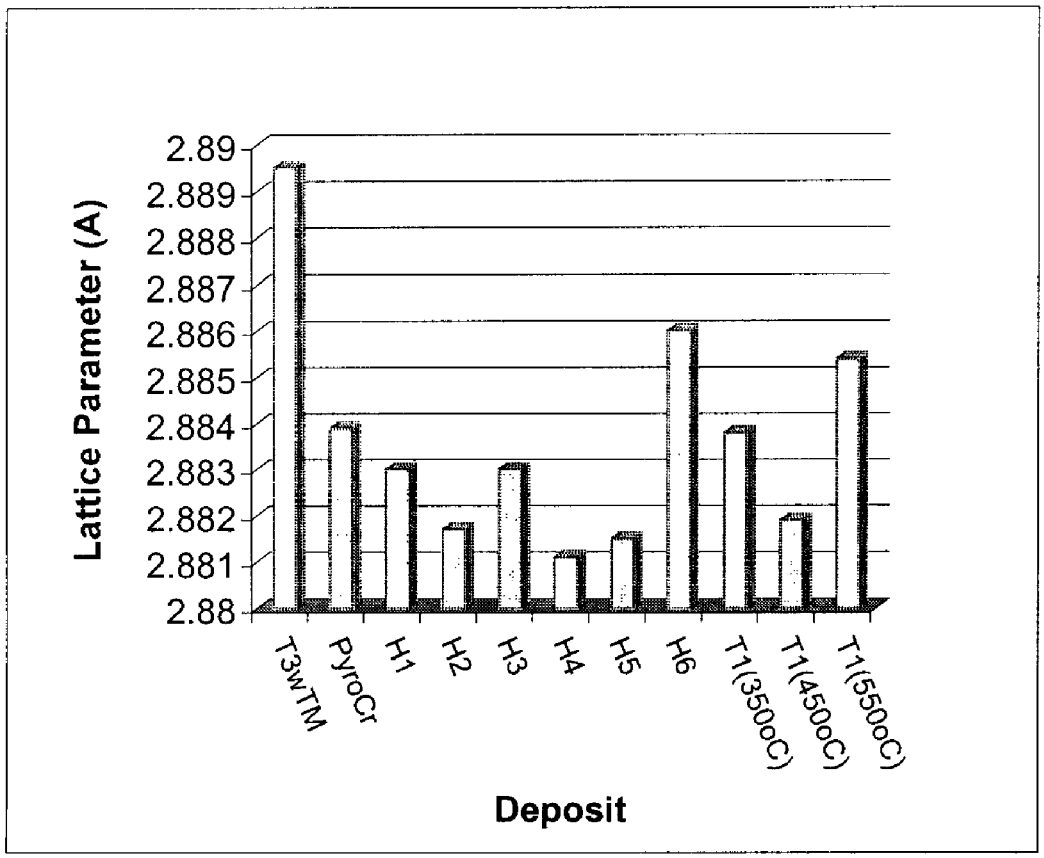
FIG. 8 is a graphical chart comparing the crystal lattice parameter, in Angstroms (Å) for (1) a crystalline chromium deposit in accordance with an embodiment of the present invention, compared with (2) crystalline chromium deposits from hexavalent chromium baths and (3) annealed amorphous-as-deposited chromium deposits.

FIG. 8 is a graphical chart comparing the crystal lattice parameter, in Angstroms (Å) for a crystalline chromium deposit in accordance with the present invention with crystalline chromium deposits from hexavalent chromium baths and annealed amorphous-as deposited chromium deposits. As shown in FIG. 8, the lattice parameter of a crystalline chromium deposit in accordance with the present invention is significantly greater and distinct from the lattice parameter of pyrometallurgically derived chromium ("PyroCr"), is significantly greater and distinct from the lattice parameters of all of the hexavalent chromium deposits ("H1"-"H6"), and is significantly greater and distinct from the lattice parameters of the annealed amorphous-as-deposited chromium deposits ("T1(350° C.)", "T1(450° C.)" and "T1(550° C.)"). The difference between the lattice parameters of the trivalent crystalline chromium deposits of the present invention and the lattice parameters of the other chromium deposits, such as those illustrated in FIG. 8, is statistically significant, at least at the 95% confidence level, according to the standard Student's 't' test.

Figure 9:
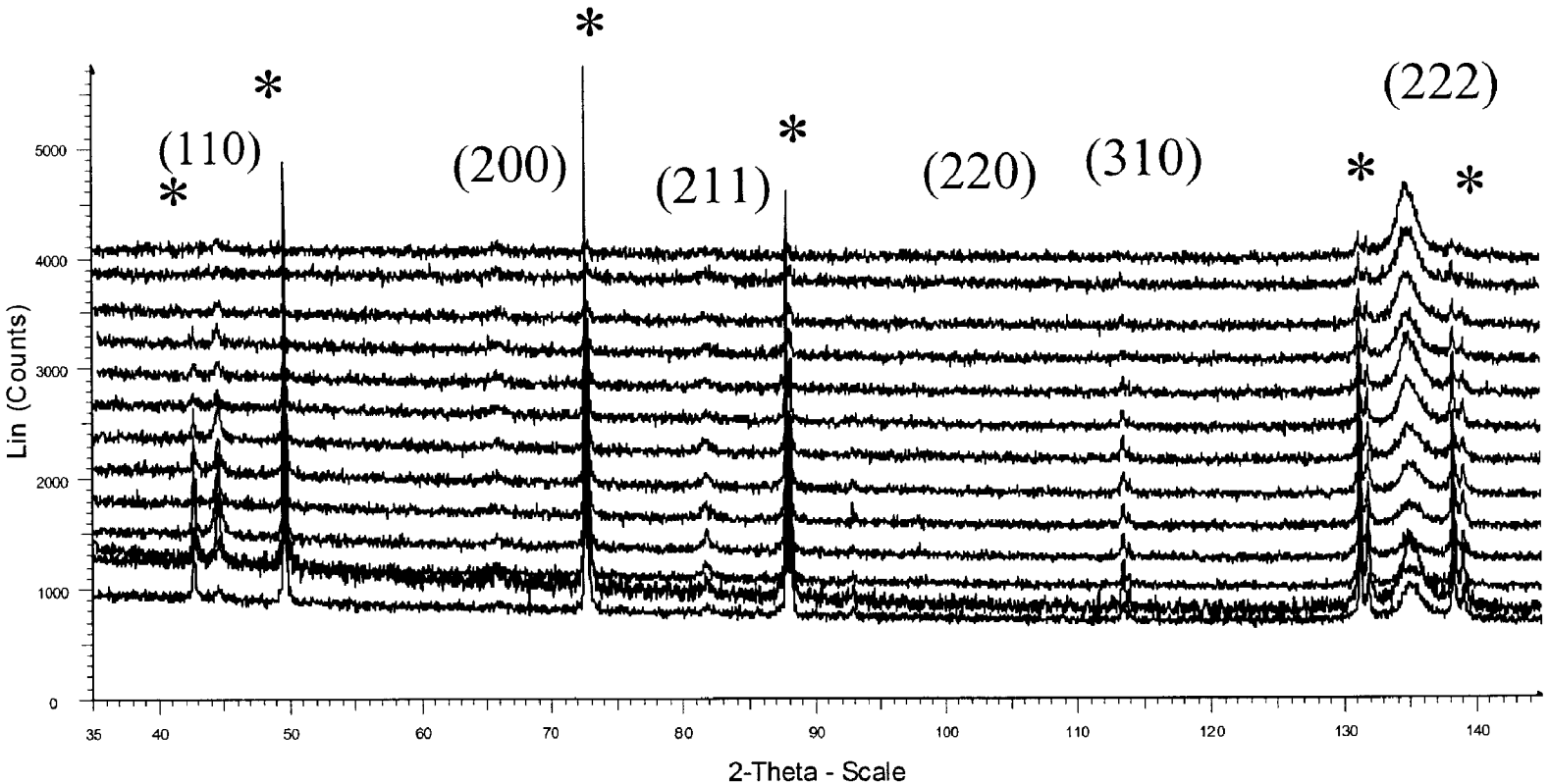
FIG. 9 is a typical X-ray diffraction pattern (Cu k alpha) showing the progressive effect of increasing amounts of thiosalicylic acid showing the reliably consistent (222) reflection, {111} preferred orientation, crystalline chromium deposit from a trivalent chromium bath in accordance with an embodiment of the present invention.

FIG. 9 is a typical X-ray diffraction pattern (Cu k alpha) showing the progressive effect of increasing amounts of thiosalicylic acid showing the reliably consistent (222) reflection, {111} preferred orientation, crystalline chromium deposit from a trivalent chromium bath in accordance with an embodiment of the present invention. In FIG. 9, crystalline chromium was deposited on brass substrates (peaks from the brass identified by (*)) from trivalent chromium electrolyte T5 (as described above) electrolyzed at 10 amps per liter (A/L) with nominal 2-6 g/L thiosalicylic acid present to an excess of 140 AH/L demonstrating reliably consistent (222) reflection, {111} preferred orientation, deposits. The samples were taken at ~14 AH intervals.

In one embodiment, the cathodic efficiency ranges from about 5% to about 80%, and in one embodiment, the cathodic efficiency ranges from about 10% to about 40%, and in another embodiment, the cathodic efficiency ranges from about 10% to about 30%.

In another embodiment additional alloying of the crystalline chromium electrodeposit, in which the chromium has a lattice constant of 2.8895+/−0.0025 Å, may be performed using ferrous sulfate and sodium hypophosphite as sources of iron and phosphorous with and without the addition of 2 g/L thiosalicylic acid. Additions of 0.1 g/L to 2 g/L of ferrous ion to electrolyte T7 result in alloys containing 2 to 20% iron. The alloys are amorphous without the addition of thiosalicylic acid. Additions of 1 to 20 g/L sodium hypophosphite resulted in alloys containing 2 to 12% phosphorous in the deposit. The alloys were amorphous unless thiosalicylic acid is added.

In another embodiment, crystalline chromium deposits having a lattice constant of 2.8895+/−0.0025 Å are obtained from electrolyte T7 with 2 g/L thiosalicylic acid agitated using ultrasonic energy at a frequency of 25 kHz and 0.5 MHz. The resulting deposits are crystalline, having a lattice constant of 2.8895+/−0.0025 Å, bright, and there is no significant variation in deposition rate regardless of the frequency used.

It is noted that, throughout the specification and claims, the numerical limits of the disclosed ranges and ratios may be combined, and are deemed to include all intervening values. Thus, for example, where ranges of 1-100 and 10-50 are specifically disclosed, ranges of 1-10, 1-50, 10-100 and 50-100 are deemed to be within the scope of the disclosure, as are the intervening integral values. Furthermore, all numerical values are deemed to be preceded by the modifier "about", whether or not this term is specifically stated. Furthermore, when the chromium deposit is electrodeposited from a trivalent chromium bath as disclosed herein in accordance with the present invention, and the thus-formed deposit is stated herein as being crystalline, it is deemed to have a lattice constant of 2.8895+/−0.0025 Å, whether or not this lattice constant is specifically stated. Finally, all possible combinations of disclosed elements and components are deemed to be within the scope of the disclosure, whether or not specifically mentioned.

While the principles of the invention have been explained in relation to certain particular embodiments, and are provided for purposes of illustration, it is to be understood that various modifications thereof will become apparent to those skilled in the art upon reading the specification. Therefore, it is to be understood that the invention disclosed herein is intended to cover such modifications as fall within the scope of the appended claims. The scope of the invention is limited only by the scope of the claims.

The invention claimed is:

1. A crystalline chromium deposit having a lattice parameter of 2.8895+/−0.0025 Å, further comprising carbon, nitrogen and sulfur in the chromium deposit.

2. The crystalline chromium deposit of claim 1 wherein the chromium deposit is electrodeposited from a trivalent chromium bath.

3. The crystalline chromium deposit of claim 1 wherein the chromium deposit comprises from about 1 wt. % to about 10 wt. % sulfur, from about 0.1 wt. % to about 5 wt. % nitrogen, and from about 0.1 wt. % to about 10 wt. % carbon.

4. The crystalline chromium deposit of claim 1 wherein the chromium deposit comprises from about 1 wt. % to about 10 wt. % sulfur.

5. The crystalline chromium of claim 1 wherein the chromium deposit comprises from about 0.1 to about 5 wt % nitrogen.

6. The crystalline chromium of claim 1 wherein the chromium deposit comprises an amount of carbon less than that amount which renders the chromium deposit amorphous.

7. The crystalline chromium deposit of claim 1 wherein the chromium deposit comprises from about 1.7 wt. % to about 4 wt. % sulfur, from about 0.1 wt. % to about 3 wt. % nitrogen, and from about 0.1 wt. % to about 10 wt. % carbon.

8. The crystalline chromium deposit of claim 1 wherein the chromium deposit is substantially free of macrocracking.

9. The crystalline chromium deposit of claim 1 wherein the chromium deposit has a {111} preferred orientation.

10. An article comprising a crystalline chromium deposit, wherein the crystalline chromium deposit has a lattice parameter of 2.8895+/−0.0025 Å and further comprises carbon, nitrogen and sulfur.

11. The article of claim 10 wherein the chromium deposit has a {111} preferred orientation.

12. The article of claim 10 wherein the chromium deposit comprises from about 1 wt. % to about 10 wt. % sulfur, from about 0.1 wt. % to about 5 wt. % nitrogen, and from about 0.1 wt. % to about 10 wt. % carbon.

13. The article of claim 10 wherein the chromium deposit is a functional or decorative chromium deposit.

14. The article of claim 10 wherein the chromium deposit comprises from about 1 wt. % to about 10 wt. % sulfur.

15. The article of claim 10 wherein the chromium deposit comprises from about 0.1 to about 5 wt % nitrogen.

16. The article of claim 10 wherein the chromium deposit comprises an amount of carbon less than that amount which renders the chromium deposit amorphous.

17. The article of claim 10 wherein the chromium deposit comprises from about 1.7 wt. % to about 4 wt. % sulfur, from about 0.1 wt. % to about 3 wt. % nitrogen, and from about 0.1 wt. % to about 10 wt. % carbon.

18. The article of claim 10 wherein the chromium deposit is substantially free of macrocracking.

19. The crystalline chromium deposit of claim 1 wherein the chromium deposit is a functional or decorative chromium deposit.

* * * * *